US010167110B2

(12) United States Patent
Koefelda et al.

(10) Patent No.: US 10,167,110 B2
(45) Date of Patent: Jan. 1, 2019

(54) DUAL HEIGHT COLLAPSIBLE CONTAINER

(75) Inventors: Gerald R. Koefelda, Berkshire (GB); Alan J. Cook, Liverpool (GB); Maurico D. Cavalcante, Atlanta, GA (US)

(73) Assignee: REHRIG PACIFIC COMPANY, Los Angeles, CA (US)

( * ) Notice: Subject to any disclaimer, the term of this patent is extended or adjusted under 35 U.S.C. 154(b) by 2066 days.

(21) Appl. No.: 13/117,195

(22) Filed: May 27, 2011

(65) Prior Publication Data

US 2011/0290811 A1 Dec. 1, 2011

Related U.S. Application Data

(60) Provisional application No. 61/348,985, filed on May 27, 2010, provisional application No. 61/356,160, (Continued)

(51) Int. Cl.
*B65D 21/02* (2006.01)
*B65D 8/14* (2006.01)
(Continued)

(52) U.S. Cl.
CPC ..... *B65D 11/1833* (2013.01); *B65D 21/0226* (2013.01); *B65D 21/062* (2013.01); (Continued)

(58) Field of Classification Search
CPC ..... B65D 21/06; B65D 5/00; B65D 21/08; B65D 21/086; B65D 21/02; B65D 21/0213; B65D 21/046; B65D 21/045; B65D 21/0235; B65D 21/062; B65D 11/18; B65D 11/0213; B65D 11/04; B65D 11/182;
(Continued)

(56) References Cited

U.S. PATENT DOCUMENTS 94,202 A * 8/1869 Gustafson ..... 47/73
446,541 A 2/1891 Stewabd
(Continued)

FOREIGN PATENT DOCUMENTS

CA 2069226 A1 3/1993
CA 2309234 A1 11/2000
(Continued)

OTHER PUBLICATIONS

Extended European Search Report dated Aug. 19, 2011 for EP11167988.

*Primary Examiner* — J. Gregory Pickett
*Assistant Examiner* — Gideon Weinerth
(74) *Attorney, Agent, or Firm* — Carlson, Gaskey & Olds, P.C.

(57) ABSTRACT

A collapsible container according to one embodiment of the present invention includes a base and a plurality of walls, including a first wall, collapsible onto the base. A support is movable between a first position and a second position relative to the first wall, such that an identical container would stack on the collapsible container at a first height when the support is in the first position and at a second height when the support is in the second position. In another embodiment, different stacking heights can be achieved by rotating the upper container 180 degrees relative to the lower container.

24 Claims, 44 Drawing Sheets

Related U.S. Application Data filed on Jun. 18, 2010, provisional application No. 61/422,872, filed on Dec. 14, 2010, provisional application No. 61/445,244, filed on Feb. 22, 2011.

(51) Int. Cl.

| | |
|---|---|
| ***B65D 6/16*** | (2006.01) |
| ***B65D 6/18*** | (2006.01) |
| ***B65D 21/032*** | (2006.01) |
| ***B65D 21/06*** | (2006.01) |
| *B65D 1/22* | (2006.01) |
| *B65D 21/08* | (2006.01) |

(52) U.S. Cl.

CPC ..... *B65D 1/225* (2013.01); *B65D 21/086* (2013.01); *B65D 2519/009* (2013.01)

(58) Field of Classification Search

CPC ..... B65D 11/26; B65D 11/1833; B65D 11/30; B65D 25/30; B65D 88/522; B65D 88/129; B65D 88/48; B65D 2519/00865; B65D 2519/0087; B65D 2519/00875; B65D 2519/0088; B65D 2519/009; B65D 2519/0092; B65D 2519/00935; B65D 2519/00955; B65D 2519/0096; B65D 2519/0094; B65D 2519/0095; B65D 1/225

USPC ..... 220/666, 6, 7; 206/507, 503, 505, 506, 206/509, 511, 512

See application file for complete search history.

(56) References Cited

U.S. PATENT DOCUMENTS

| | | | | | |
|---|---|---|---|---|---|
| 1,082,274 | A | | 12/1913 | Lapish | |
| 1,378,614 | A | | 5/1921 | James | |
| 1,689,217 | A | | 10/1928 | White | |
| 1,809,523 | A | | 6/1931 | McLean | |
| 2,134,875 | A | | 11/1938 | Henze | |
| 2,221,504 | A | | 11/1940 | Beasley | |
| 2,297,097 | A | * | 9/1942 | Best | 220/668 |
| 2,462,693 | A | * | 2/1949 | Wabshaw | 206/505 |
| 2,512,522 | A | | 6/1950 | Brooks | |
| 2,528,551 | A | | 11/1950 | Ross | |
| 2,553,607 | A | | 5/1951 | Rosenberg | |
| 2,747,748 | A | | 5/1956 | Barefoot | |
| 2,755,955 | A | * | 7/1956 | Gordon | 220/6 |
| 2,760,669 | A | | 8/1956 | Kreutzer | |
| 2,777,627 | A | | 1/1957 | Crane | |
| 2,782,950 | A | | 2/1957 | Corr | |
| 2,850,204 | A | | 9/1958 | Rehrig | |
| 2,964,211 | A | * | 12/1960 | Pfeffer | 220/494 |
| RE25,050 | E | | 10/1961 | Hamilton | |
| 3,186,585 | A | | 6/1965 | Denny | |
| 3,220,603 | A | | 11/1965 | Bromley | |
| 3,270,913 | A | * | 9/1966 | Bridenstine et al. | 206/507 |
| 3,272,377 | A | * | 9/1966 | Schray | 220/494 |
| 3,360,180 | A | | 12/1967 | Venturi | |
| 3,374,915 | A | | 3/1968 | Verhein | |
| 3,379,339 | A | * | 4/1968 | Asenbauer | 206/506 |
| 3,421,656 | A | * | 1/1969 | Asenbauer | 206/506 |
| 3,446,415 | A | | 5/1969 | Bromley | |
| 3,448,914 | A | * | 6/1969 | Scholz | 206/509 |
| 3,591,212 | A | | 7/1971 | Rhyne | |
| 3,685,718 | A | | 8/1972 | Chidgey | |
| 3,840,115 | A | * | 10/1974 | Ladewig | 206/506 |
| 3,853,238 | A | | 12/1974 | Frieder et al. | |
| 3,874,546 | A | | 4/1975 | Sanders et al. | |
| 3,895,715 | A | | 7/1975 | Drader et al. | |
| 3,904,066 | A | | 9/1975 | Wilson et al. | |
| 3,951,265 | A | | 4/1976 | Carroll | |
| 3,982,650 | A | | 9/1976 | Ichihara | |
| 4,000,817 | A | * | 1/1977 | Sanders | B65D 21/041 206/505 |
| 4,049,113 | A | | 9/1977 | Joyce et al. | |
| 4,090,633 | A | | 5/1978 | Trubiano et al. | |
| 4,106,623 | A | | 8/1978 | Carroll et al. | |
| 4,109,791 | A | | 8/1978 | Clipson et al. | |
| 4,148,407 | A | | 4/1979 | Sinclair | |
| 4,214,669 | A | | 7/1980 | McQuiston | |
| 4,241,831 | A | | 12/1980 | Locatelli | |
| 4,247,004 | A | | 1/1981 | Bird | |
| 4,293,069 | A | | 10/1981 | Partain | |
| 4,391,369 | A | | 7/1983 | Stahl et al. | |
| 4,391,969 | A | | 7/1983 | McBee et al. | |
| 4,423,813 | A | | 1/1984 | Kreeger et al. | |
| 4,426,001 | A | * | 1/1984 | Stahl | B65D 21/046 206/505 |
| 4,466,541 | A | | 8/1984 | Tabler et al. | |
| 4,505,422 | A | | 3/1985 | Vossen | |
| 4,508,237 | A | | 4/1985 | Kreeger et al. | |
| 4,573,577 | A | * | 3/1986 | Miller | 206/506 |
| 4,579,220 | A | | 4/1986 | Brundage | |
| 4,591,065 | A | * | 5/1986 | Foy | 220/7 |
| RE32,223 | E | | 8/1986 | Kreeger et al. | |
| 4,619,366 | A | * | 10/1986 | Kreeger | 206/507 |
| 4,624,381 | A | | 11/1986 | Friedrich | |
| 4,643,310 | A | | 2/1987 | Deaton et al. | |
| 4,720,013 | A | | 1/1988 | Nichols et al. | |
| 4,735,330 | A | | 4/1988 | Hoss | |
| 4,735,331 | A | | 4/1988 | Keenan et al. | |
| 4,759,451 | A | | 7/1988 | Apps | |
| 4,773,533 | A | | 9/1988 | Greene | |
| 4,848,578 | A | | 7/1989 | Schafer | |
| 4,863,062 | A | | 9/1989 | Holliday | |
| 4,887,874 | A | | 12/1989 | Joffe | |
| 4,901,859 | A | | 2/1990 | Jones | |
| 4,905,833 | A | | 3/1990 | Kreeger | |
| 4,917,255 | A | | 4/1990 | Foy | |
| 4,923,079 | A | | 5/1990 | Foy | |
| 4,946,093 | A | | 8/1990 | Moorman | |
| 4,947,992 | A | | 8/1990 | Schafer | |
| 4,960,223 | A | | 10/1990 | Chiang et al. | |
| 5,083,666 | A | | 1/1992 | Lam | |
| 5,094,356 | A | | 3/1992 | Miller | |
| 5,114,037 | A | * | 5/1992 | Hillis | B65D 19/18 220/1.5 |
| 5,161,709 | A | | 11/1992 | Oestreich | |
| 5,332,114 | A | | 7/1994 | Sano | |
| 5,398,825 | A | | 3/1995 | Erwin | |
| 5,398,834 | A | | 3/1995 | Umiker | |
| 5,398,835 | A | | 3/1995 | Blinstrub | |
| 5,467,885 | A | | 11/1995 | Blinstrub | |
| 5,469,986 | A | * | 11/1995 | Jang | 220/762 |
| 5,494,163 | A | | 2/1996 | Apps | |
| 5,515,987 | A | * | 5/1996 | Jacques et al. | 220/6 |
| 5,586,675 | A | | 12/1996 | Borsboom et al. | |
| 5,588,549 | A | | 12/1996 | Furtner et al. | |
| 5,609,254 | A | | 3/1997 | Loftus et al. | |
| 5,632,392 | A | | 5/1997 | Oh | |
| D381,203 | S | | 7/1997 | Ackermann et al. | |
| 5,671,857 | A | | 9/1997 | Stromberg | |
| 5,772,033 | A | | 6/1998 | Loftus et al. | |
| 5,797,508 | A | * | 8/1998 | Loftus et al. | 220/6 |
| 5,853,099 | A | | 12/1998 | Lessard | |
| 5,860,527 | A | | 1/1999 | Frankenberg et al. | |
| 5,924,572 | A | | 7/1999 | Cope et al. | |
| 5,975,324 | A | | 11/1999 | Schmitt | |
| 6,015,056 | A | | 1/2000 | Overholt et al. | |
| 6,029,840 | A | | 2/2000 | Brauner | |
| 6,056,177 | A | | 5/2000 | Schneider | |
| 6,059,114 | A | | 5/2000 | Loftus | |
| 6,073,790 | A | | 6/2000 | Umiker | |
| 6,082,570 | A | | 7/2000 | Tai | |
| 6,098,827 | A | | 8/2000 | Overholt et al. | |
| 6,142,329 | A | | 11/2000 | Dotan | |
| 6,179,156 | B1 | | 1/2001 | Aiken | |
| 6,209,741 | B1 | * | 4/2001 | Boucher-Giles | 220/6 |
| 6,209,742 | B1 | | 4/2001 | Overholt et al. | |
| D446,392 | S | | 8/2001 | Overholt et al. | |
| 6,286,701 | B1 | | 9/2001 | Umiker | |

(56) References Cited

U.S. PATENT DOCUMENTS

| | | | | |
|---|---|---|---|---|
| 6,290,081 | B1 | 9/2001 | Merey | |
| 6,293,418 | B1 | 9/2001 | Ogden et al. | |
| D452,614 | S | 1/2002 | Overholt | |
| 6,382,458 | B2 | 5/2002 | Mori | |
| 6,386,388 | B1 | 5/2002 | Overholt | |
| D458,753 | S | 6/2002 | Overholt et al. | |
| 6,398,054 | B1 | 6/2002 | Overholt et al. | |
| 6,405,888 | B1 | 6/2002 | Overholt et al. | |
| 6,409,041 | B1 | 6/2002 | Overholt et al. | |
| 6,446,825 | B1 | 9/2002 | Godoy | |
| 6,460,717 | B1 | 10/2002 | Smyers et al. | |
| 6,581,330 | B1 | 6/2003 | Helsloot et al. | |
| 6,631,822 | B1 | 10/2003 | Overholt | |
| 6,722,516 | B1 | 4/2004 | Zelko | |
| 6,772,897 | B2 | 8/2004 | Kellerer et al. | |
| 6,863,180 | B2 | 3/2005 | Apps | |
| 6,994,216 | B2 | 2/2006 | Wong | |
| 7,017,766 | B2 | 3/2006 | Hsu et al. | |
| 7,063,223 | B2 * | 6/2006 | Iwahara et al. | 220/6 |
| 7,195,128 | B2 | 3/2007 | Murakami et al. | |
| 7,267,227 | B2 * | 9/2007 | Dubois et al. | 206/506 |
| 7,438,197 | B2 * | 10/2008 | Yamauchi | 220/7 |
| 7,464,817 | B2 * | 12/2008 | Raghunathan et al. | 206/506 |
| 7,556,166 | B2 * | 7/2009 | Parnall | B65D 11/1833 220/4.28 |
| 7,617,947 | B2 * | 11/2009 | Schafer | 220/558 |
| 7,641,066 | B2 * | 1/2010 | Baltz | 220/7 |
| 7,823,728 | B2 * | 11/2010 | Baltz | 206/506 |
| 8,056,723 | B2 * | 11/2011 | Cavalcante | 206/511 |
| 8,091,706 | B2 * | 1/2012 | Koefelda | 206/506 |
| 8,684,209 | B2 * | 4/2014 | Choi | B65D 11/18 206/505 |
| 2002/0108950 | A1 * | 8/2002 | Moorman et al. | 220/7 |
| 2002/0117420 | A1 | 8/2002 | McDade | |
| 2003/0000950 | A1 | 1/2003 | Murakami et al. | |
| 2003/0116564 | A1 | 6/2003 | Overholt et al. | |
| 2003/0132228 | A1 | 7/2003 | Apps | |
| 2003/0222081 | A1 * | 12/2003 | Apps et al. | 220/7 |
| 2003/0230510 | A1 | 12/2003 | Aiken et al. | |
| 2004/0069780 | A1 | 4/2004 | Apps | |
| 2004/0129700 | A1 | 7/2004 | Oster et al. | |
| 2004/0159659 | A1 * | 8/2004 | Rumpel | 220/7 |
| 2004/0178197 | A1 * | 9/2004 | Hsu et al. | 220/7 |
| 2004/0200833 | A1 | 10/2004 | Dubois et al. | |
| 2005/0040166 | A1 * | 2/2005 | Nolet et al. | 220/6 |
| 2005/0098556 | A1 | 5/2005 | Kellerer | |
| 2005/0194382 | A1 | 9/2005 | B. | |
| 2005/0263423 | A1 * | 12/2005 | Hassell et al. | 206/506 |
| 2005/0263424 | A1 * | 12/2005 | Hassell et al. | 206/506 |
| 2006/0011627 | A1 * | 1/2006 | Overholt et al. | 220/7 |
| 2006/0065567 | A1 * | 3/2006 | Hassell et al. | 206/506 |
| 2006/0231449 | A1 * | 10/2006 | Hassell et al. | 206/506 |
| 2006/0237341 | A1 * | 10/2006 | McDade | 206/509 |
| 2007/0095842 | A1 | 5/2007 | Apps | |
| 2007/0125779 | A1 * | 6/2007 | Cope | 220/6 |
| 2007/0144931 | A1 | 6/2007 | McTavish | |
| 2007/0194023 | A1 * | 8/2007 | Apps et al. | 220/6 |
| 2008/0164175 | A1 * | 7/2008 | Meissen | 206/506 |
| 2009/0078701 | A1 * | 3/2009 | Cavalcante | 220/7 |
| 2010/0044371 | A1 * | 2/2010 | Koefelda | 220/7 |
| 2010/0051497 | A1 * | 3/2010 | Meers | 206/514 |
| 2010/0126896 | A1 * | 5/2010 | Barbalho | 206/505 |
| 2010/0133266 | A1 * | 6/2010 | Cook et al. | 220/6 |
| 2013/0056381 | A1 * | 3/2013 | Cook et al. | 206/506 |
| 2013/0180982 | A1 * | 7/2013 | Choi | 220/6 |
| 2015/0197365 | A1 * | 7/2015 | Josefson | 220/6 |

FOREIGN PATENT DOCUMENTS

| | | | |
|---|---|---|---|
| DE | 1536040 | A1 | 12/1969 |
| DE | 2007788 | A1 | 8/1971 |
| DE | 2033724 | A1 | 1/1972 |
| DE | 2540005 | A1 | 4/1976 |
| DE | 3124360 | A1 | 12/1982 |
| DE | 8303842 | U1 | 1/1984 |
| DE | 3511321 | A1 | 10/1986 |
| DE | 3521894 | A1 | 1/1987 |
| DE | 9103975 | U1 | 11/1991 |
| DE | 4102082 | A1 | 7/1992 |
| DE | 4228819 | A1 | 3/1994 |
| DE | 29501696 | U1 | 4/1995 |
| DE | 9320047 | U1 | 6/1995 |
| DE | 19506228 | A1 | 9/1995 |
| DE | 19939019 | A1 | 2/2001 |
| DE | 20002537 | U1 | 7/2001 |
| EP | 299657 | A1 | 1/1989 |
| EP | 341074 | A1 | 11/1989 |
| EP | 385914 | A1 | 9/1990 |
| EP | 413884 | A1 | 6/1994 |
| EP | 404041 | A1 | 2/1995 |
| EP | 505585 | A1 | 6/1995 |
| EP | 690003 | A1 | 1/1996 |
| EP | 751074 | A1 | 1/1997 |
| EP | 785142 | A1 | 7/1997 |
| EP | 856469 | A2 | 8/1998 |
| EP | 705764 | A2 | 2/1999 |
| EP | 962394 | A1 | 12/1999 |
| EP | 932560 | A1 | 7/2001 |
| EP | 1114779 | A2 | 7/2001 |
| EP | 1160169 | A2 | 12/2001 |
| EP | 1182139 | A2 | 2/2002 |
| EP | 841254 | A1 | 9/2002 |
| EP | 818394 | A2 | 1/2003 |
| EP | 1150901 | A1 | 5/2003 |
| EP | 962396 | A1 | 3/2004 |
| EP | 1025011 | A1 | 4/2004 |
| EP | 1261937 | A1 | 1/2005 |
| EP | 1609725 | A1 | 12/2005 |
| EP | 1241105 | A1 | 3/2006 |
| EP | 1785360 | A1 | 5/2007 |
| EP | 2072413 | A2 | 6/2009 |
| FR | 1040163 | A | 10/1953 |
| FR | 2325565 | A1 | 4/1977 |
| FR | 2627746 | A1 | 9/1989 |
| FR | 2701690 | A1 | 8/1994 |
| FR | 2702198 | A1 | 9/1994 |
| FR | 2843945 | A1 | 3/2004 |
| GB | 916356 | A | 1/1963 |
| GB | 947404 | A | 1/1964 |
| GB | 1198681 | A | 7/1970 |
| GB | 1215049 | A | 12/1970 |
| GB | 1335729 | A | 10/1973 |
| GB | 2068338 | A | 8/1981 |
| GB | 2129401 | A | 5/1984 |
| GB | 2139189 | A | 11/1984 |
| GB | 2141778 | A | 1/1985 |
| GB | 2171980 | A | 9/1986 |
| GB | 2174678 | A | 11/1986 |
| GB | 2208166 | A | 3/1989 |
| GB | 2235429 | A | 3/1991 |
| GB | 2245251 | A | 1/1992 |
| GB | 2249750 | A | 5/1992 |
| GB | 2255076 | A | 10/1992 |
| GB | 2257422 | A | 1/1993 |
| GB | 2264102 | A | 8/1993 |
| GB | 2267302 | A | 12/1993 |
| GB | 2279674 | A | 1/1995 |
| GB | 2281897 | A | 3/1995 |
| GB | 2283728 | A | 5/1995 |
| GB | 2284587 | A | 6/1995 |
| GB | 2287241 | A | 9/1995 |
| GB | 2296009 | A | 6/1996 |
| GB | 2313361 | A | 11/1997 |
| GB | 2328246 | A | 2/1999 |
| GB | 2329890 | A | 4/1999 |
| GB | 2330131 | A | 4/1999 |
| GB | 2330826 | A | 5/1999 |
| GB | 2331744 | A | 6/1999 |
| GB | 2331980 | A | 6/1999 |
| GB | 2331983 | A | 6/1999 |
| GB | 2333285 | A | 7/1999 |
| GB | 2334007 | A | 8/1999 |
| GB | 2334508 | A | 8/1999 |

(56) References Cited

FOREIGN PATENT DOCUMENTS

| | | | |
|---|---|---|---|
| GB | 2339567 | A | 2/2000 |
| GB | 2340108 | A | 2/2000 |
| GB | 2340482 | A | 2/2000 |
| GB | 2340485 | A | 2/2000 |
| GB | 2342309 | A | 4/2000 |
| GB | 2345053 | A | 6/2000 |
| GB | 2345901 | A | 7/2000 |
| GB | 2346367 | A | 8/2000 |
| GB | 2350350 | A | 11/2000 |
| GB | 2351784 | A | 1/2001 |
| GB | 2353276 | A | 2/2001 |
| GB | 2359066 | A | 8/2001 |
| GB | 236076 | A | 10/2001 |
| GB | 2368074 | A | 4/2002 |
| GB | 2370034 | A | 6/2002 |
| GB | 2373238 | A | 9/2002 |
| GB | 2373239 | A | 9/2002 |
| GB | 2373240 | A | 9/2002 |
| GB | 2374859 | A | 10/2002 |
| GB | 2377695 | A | 1/2003 |
| GB | 2378680 | A | 2/2003 |
| GB | 2381050 | A | 4/2003 |
| GB | 2392149 | A | 2/2004 |
| GB | 2406332 | A | 3/2005 |
| GB | 2409850 | A | 7/2005 |
| GB | 2431917 | A | 5/2007 |
| GB | 2431921 | A | 5/2007 |
| GB | 2431922 | A | 5/2007 |
| GB | 2438506 | A | 11/2007 |
| GB | 2443949 | A | 5/2008 |
| GB | 2463374 | A | 3/2010 |
| JP | 11222233 | A | 8/1999 |
| JP | 2000118529 | | 4/2000 |
| JP | 2000355323 | A | 12/2000 |
| JP | 2001180670 | A | 7/2001 |
| JP | 2003020037 | A | 1/2003 |
| NL | 7905105 | A | 12/1980 |
| NL | 9002518 | A | 6/1992 |
| NL | 9301566 | A | 4/1995 |
| SE | 210889 | C | 4/1963 |
| SU | 1533952 | A1 | 1/1990 |
| WO | 9324378 | A1 | 12/1993 |
| WO | 9749613 | A1 | 12/1997 |
| WO | 9856668 | A1 | 12/1998 |
| WO | 0027716 | A1 | 5/2000 |
| WO | 0066440 | A1 | 11/2000 |
| WO | 0144060 | A1 | 6/2001 |
| WO | 0206128 | A1 | 1/2002 |
| WO | 0234630 | A1 | 5/2002 |
| WO | 03104094 | A1 | 12/2003 |
| WO | 2008062494 | A1 | 5/2008 |

* cited by examiner

DUAL HEIGHT COLLAPSIBLE CONTAINER

This application claims priority to U.S. Provisional Application Ser. Nos. 61/348,985, filed May 27, 2010; 61/356,160 filed Jun. 18, 2010; 61/422,872, filed Dec. 14, 2010 and 61/445,244 filed Feb. 22, 2011.

BACKGROUND

Collapsible containers are sometimes used to ship and store products. Collapsible containers include a plurality of walls pivotably connected to a base, such that the walls can be collapsed onto the base when empty. In the collapsed position, the containers occupy less space and are more efficiently stored and shipped.

SUMMARY

A collapsible container according to one embodiment of the present invention includes a base and a plurality of walls, including a first wall, collapsible onto the base. A support is movable between a first position and a second position relative to the first wall, such that an identical container would stack on the collapsible container at a first height when the support is in the first position and at a second height when the support is in the second position.

The support may be pivotably connected to the first wall, such that the first position is a retracted position and wherein the second position is an extended position.

If the first height is greater than the second height, then the containers can accommodate more (or larger) goods when the support is in the first position and the containers can more efficiently accommodate fewer (or smaller) goods when the support is in the second position by reducing the overall height of the stack of containers.

In another embodiment, the first height with the support in the retracted position, is less than the second height, with the support in the extended position.

In one embodiment, the first wall includes a detent or stop for preventing the support from moving from the first position to the second position until a user manually moves the support to the second position.

According to another feature, a periphery of the base of the collapsible container includes a plurality of alternating recesses and projections complementary to a plurality of alternating recesses and projections at an upper edge of the plurality of walls.

At least one of the walls is connected by a hinge to the base. The hinge is contained within one of the plurality of projections of the periphery of the base.

The base includes a planar portion that may have at least one foot projecting downward therefrom. When the identical container is stacked at the first height on the collapsible container, the foot of the identical container extends below the uppermost edge of the plurality of walls of the collapsible container and the planar portion is above the uppermost edge of the plurality of walls of the collapsible container. The planar portion of the identical container may be stacked on the support when the support is in the second position.

In some embodiments, the base of the identical container is stacked on the support when the support is in the second position.

In one embodiment, the support is pivotably and slidably connected to the first wall.

DETAILED DESCRIPTION OF A PREFERRED EMBODIMENT

Figure 1:
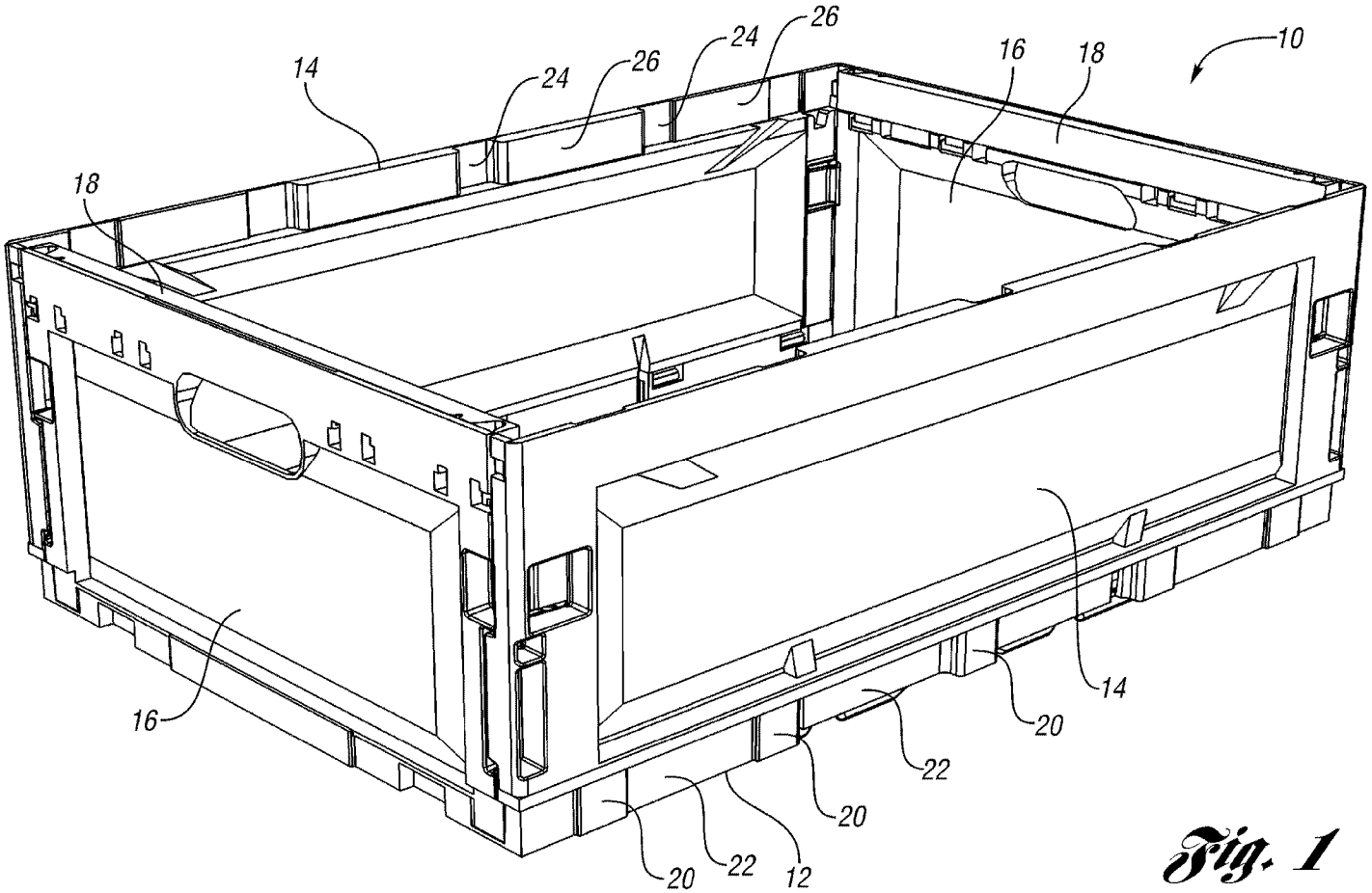
FIG. 1 is a perspective view of a collapsible container according to first embodiment of the present invention.

A collapsible container 10 according to one embodiment of the present invention is shown in FIG. 1. The container 10 includes a base 12 having side walls 14 or long walls pivotably connected to side edges of the base 12 and end walls 16 or short walls pivotably connected to end edges of the base 12. Supports 18 are pivotably connected to the end walls 16.

The outer periphery of the base 12 includes a plurality of projections 20 alternating with recesses 22. Similarly, the interior periphery of the upper edge of the side walls 14 includes alternating recesses 24 and projections 26 complementary to the projections 20 and recesses 22 on the base 12.

Figure 2:
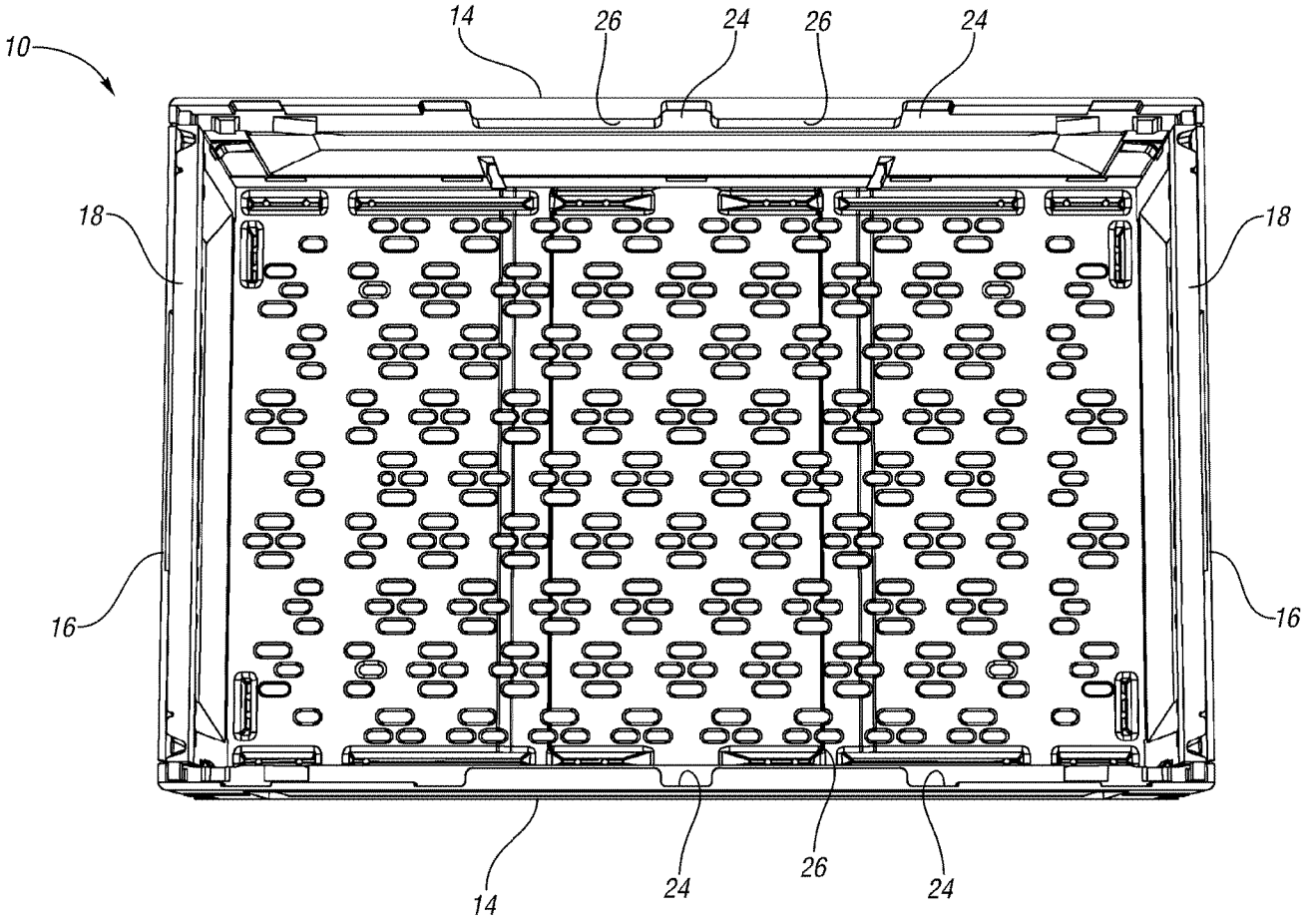
FIG. 2 is an upper perspective view of the container of FIG. 1.
Figure 3:
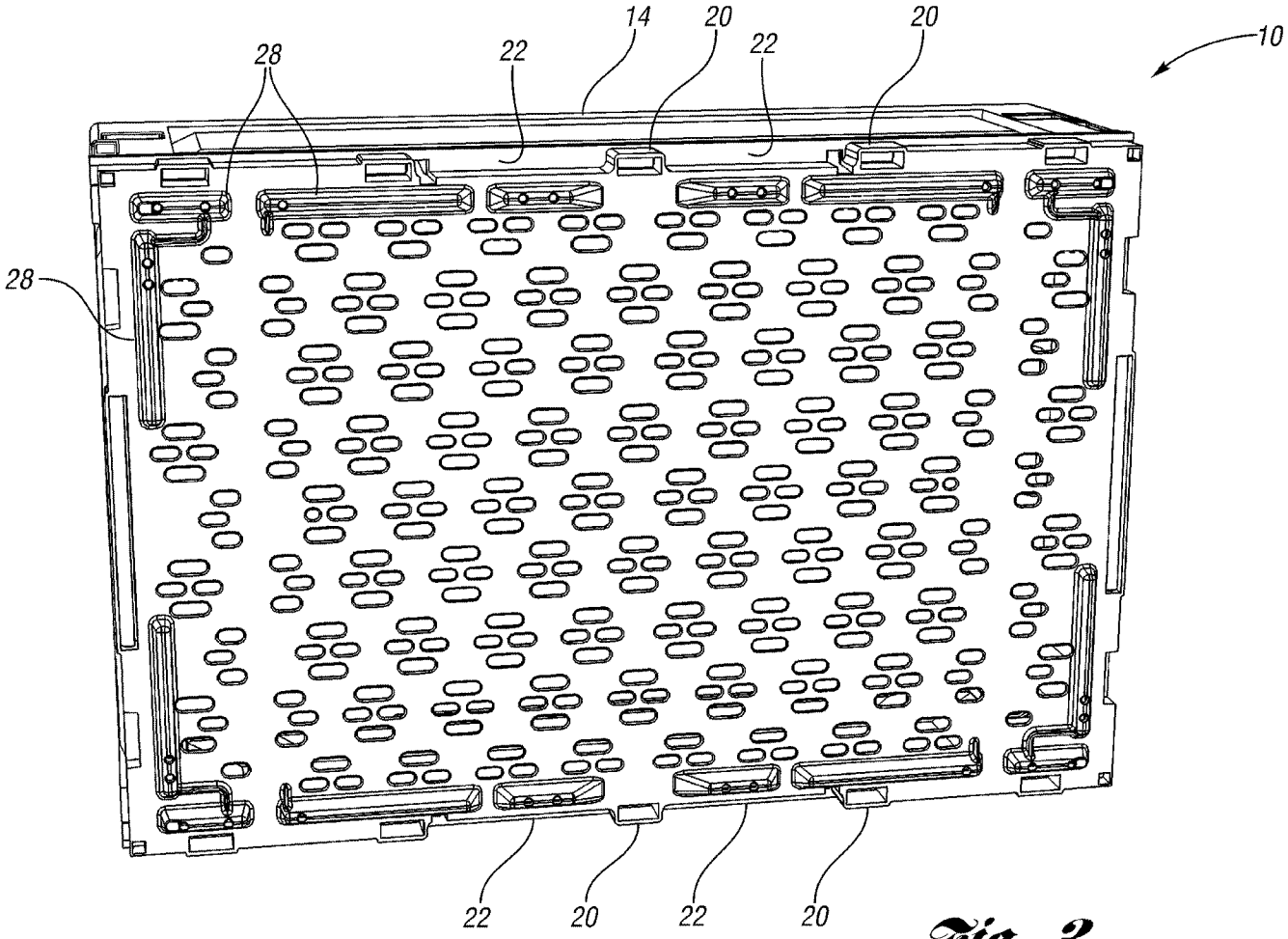
FIG. 3 is a bottom perspective view of the container of FIG. 1.

FIG. 2 is an upper perspective view of the container 10. FIG. 3 is a bottom perspective view of the container 10. As shown in FIGS. 2 and 3, the projections 20 and recesses 22 on the base 12 are complementary to and aligned with the recesses 24 and projections 26 on the interior of the upper edge of the side walls 14. Also shown in FIG. 3 are a plurality of drag rails or feet 28. The feet 28 project downwardly from the generally planar portion of the base 12.

Figure 4:
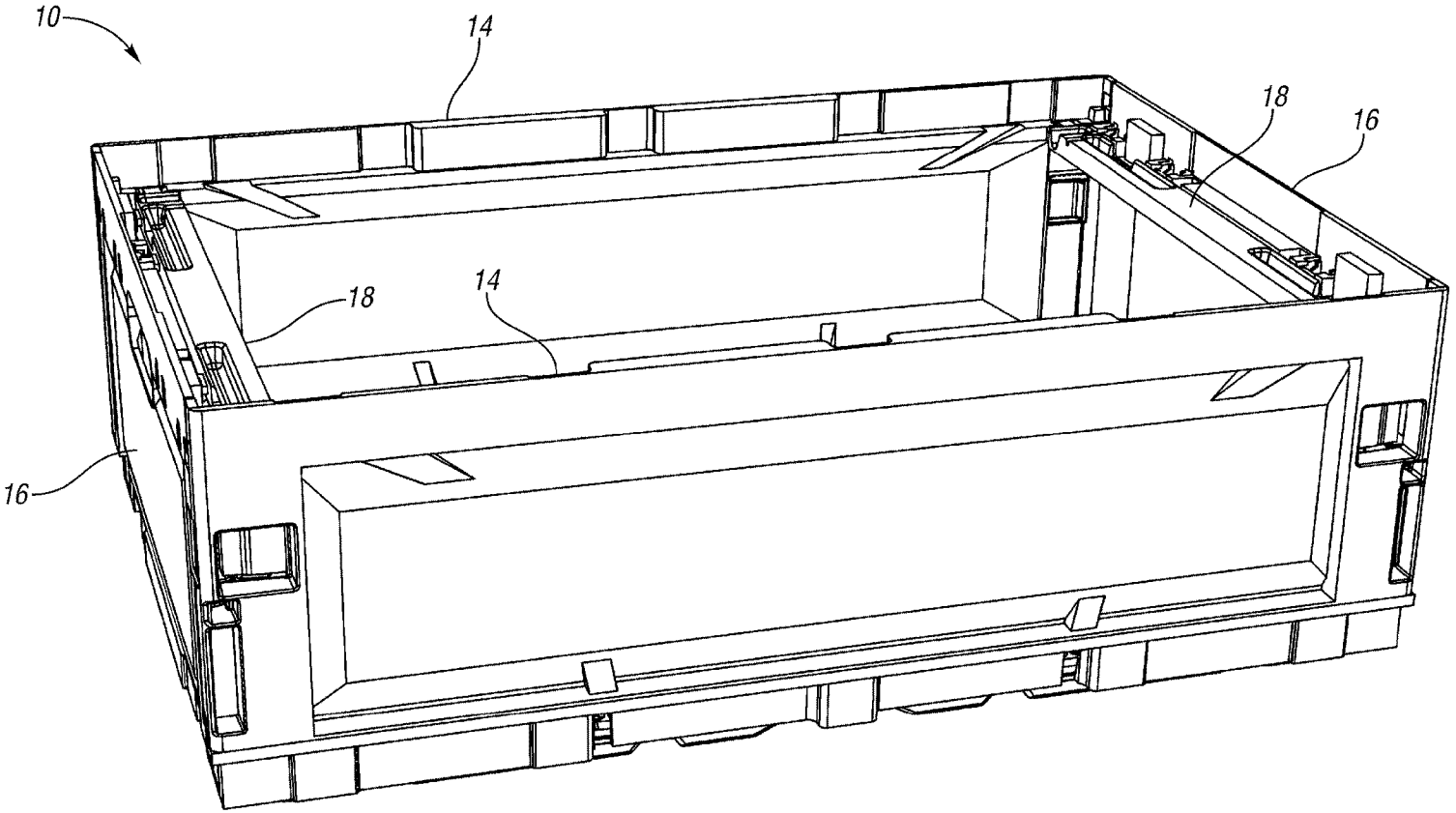
Figure 5:
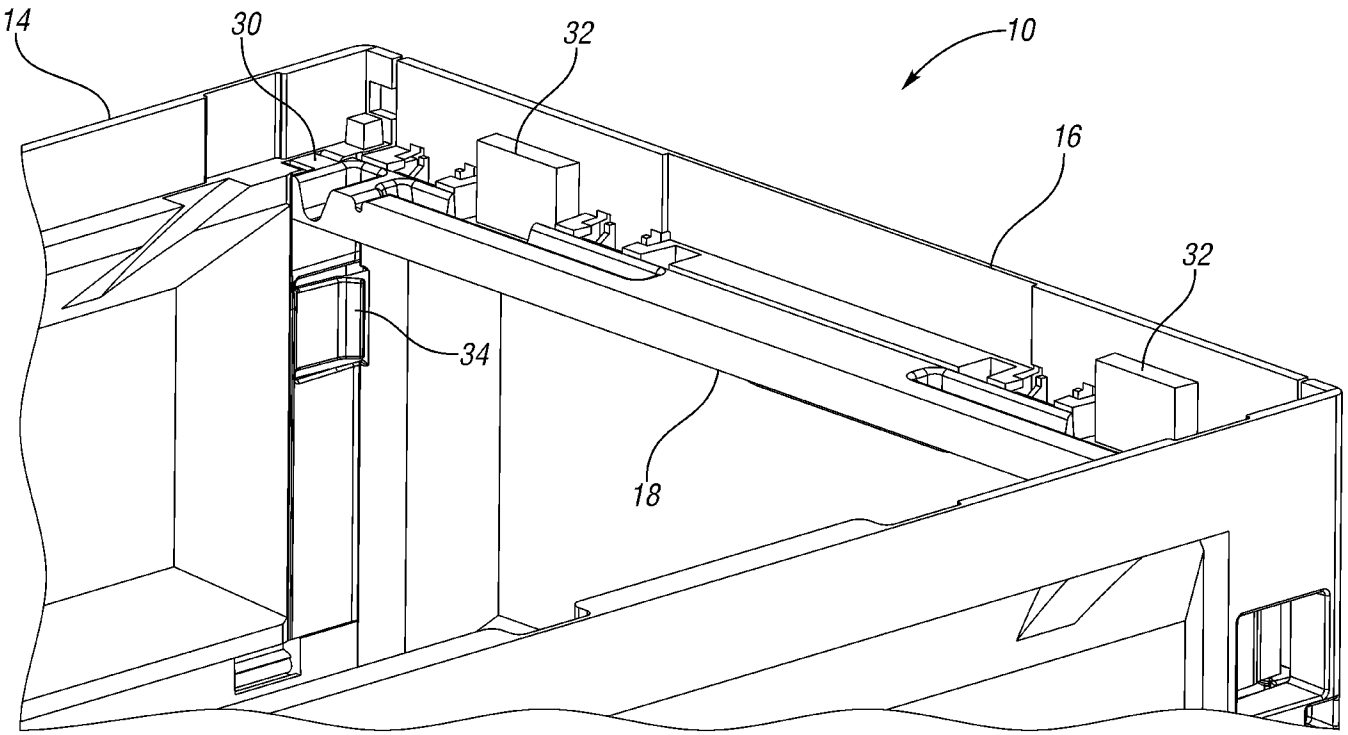
FIG. 5 is an enlarged interior view of one end of the container of FIG. 1.

In FIGS. 1 and 2, the supports 18 are shown pivoted to the upright, retracted position. In FIG. 4, the supports 18 are shown pivoted downward to a horizontal or extended position, where the support 18 extends further into the interior of the container 10. FIG. 5 is an enlarged interior view of one end of the container 10. Each support 18 includes a tab 30 projecting from each end and which rests on a surface of the side wall 14 when the support 18 is in the extended position. Stops 32 are formed in the end walls 16. The stops 32 contact the support 18 when the support 18 is in the upright, retracted position. The stops 32 prevent the support 18 from moving from the retracted position to the extend position until the support 18 is lifted off of the stops 32. As shown, the side walls 14 and end walls 16 may be connected by latches 34.

Figure 7:
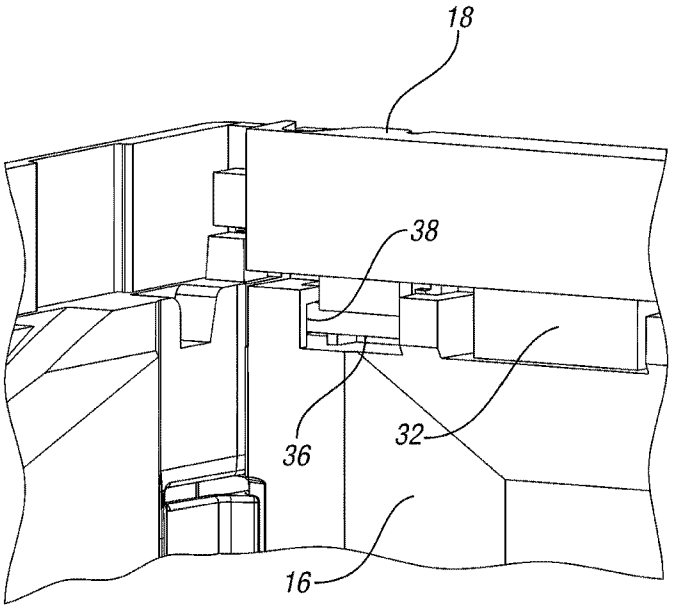
FIGS. 6 and 7 are enlarged interior views of one corner of the container of FIG. 1.
Figure 6:
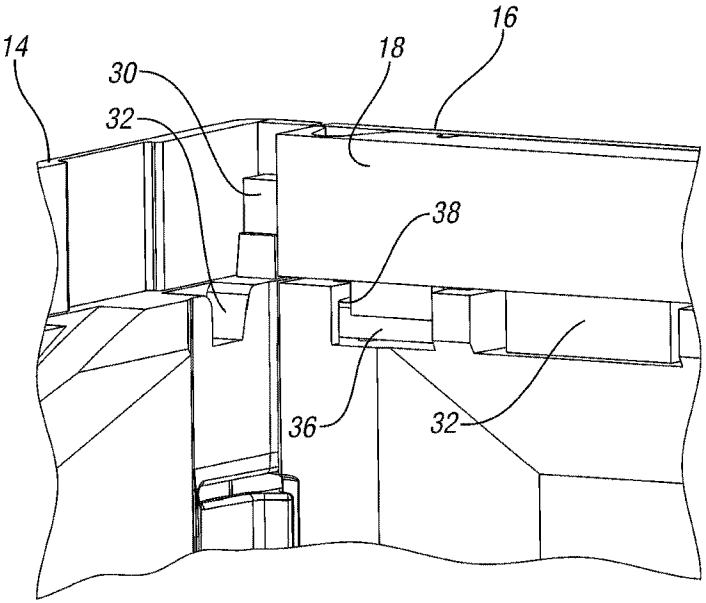

FIGS. 6 and 7 are enlarged interior views of one corner of the container 10. Referring to FIG. 6, the support 18 is pivotably connected to the end walls 16 by a hinge including a hinge pin 36 integrally molded with the support 18 and a hinge receiver 38 integrally molded with the end walls 16. As can be seen with reference to FIGS. 6 and 7, the hinge pin 36 is slidable within the hinge receiver 38 vertically to permit the support 18 to be lifted off of the stops 32 to permit the support 18 to be pivoted from the retracted position to the extended position. Referring to FIG. 6, the side wall 14 includes a support surface for supporting the tab 30 of the support 18 when the support 18 is in the extended position.

Figure 8:
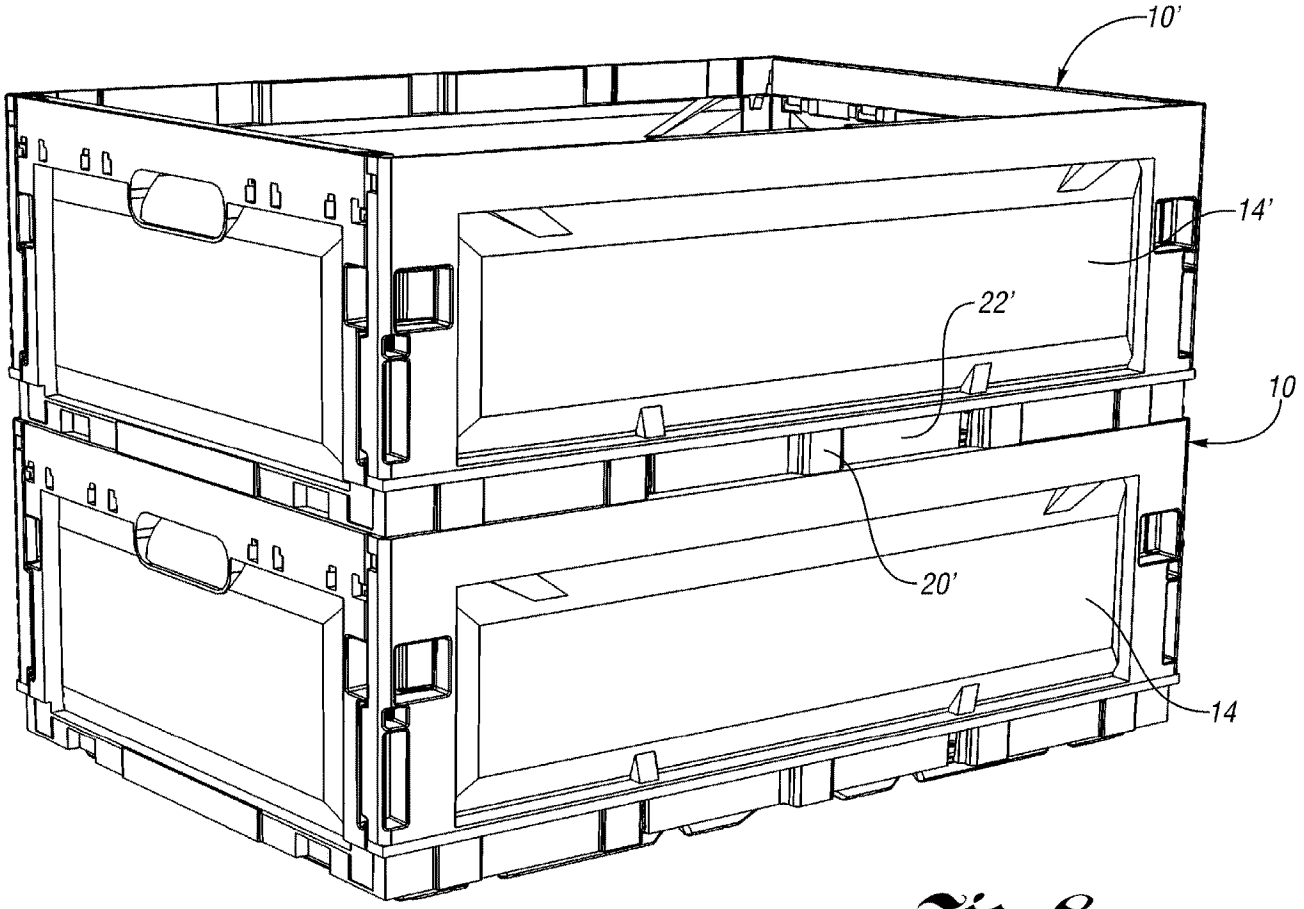
FIG. 8 shows an identical container stacked on the container of FIG. 1 in a high stack position.
Figure 9:
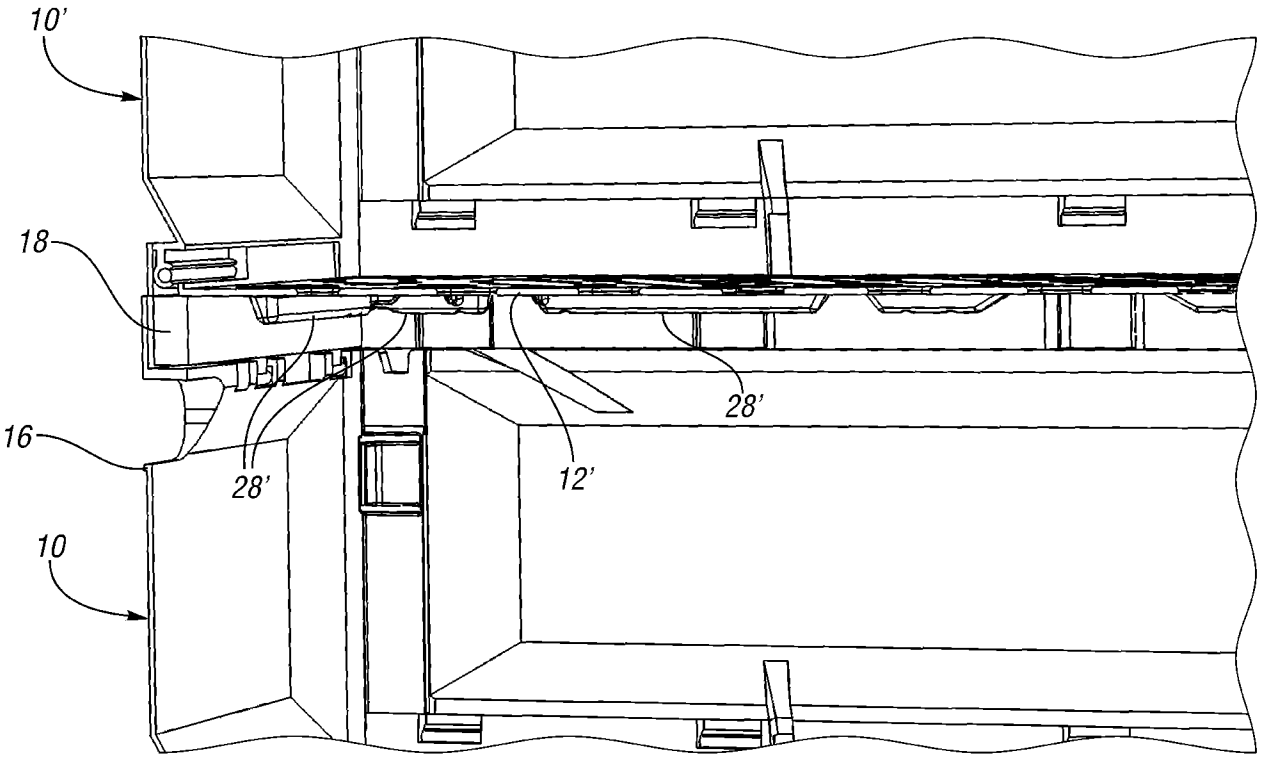
FIG. 9 is a side view of one end of the containers of FIG. 8, partially broken away.

Referring to FIG. 8, when the supports 18 are in the retracted, vertical position, an identical container 10' stacked on the container 10 will contact the supports 18 (not visible in FIG. 8). This places the stacking height of the containers 10, 10' such that the base 12' of the upper container 10' is above or even with the upper edges of the walls 14, 16 of the lower container 10. Alternatively, the base 12' could be slightly below the upper edges of the walls 14, 16. As shown in FIG. 9, the base 12' of the upper container 10' (such as the planar portion of the base 12') rests on the support 18 in the vertical, retracted position. The feet 28' of the upper container 10' are received within the periphery of the walls 14, 16 of the lower container 10 and inward of the supports 18. With the upper container 10' stacked thereon, the supports 18 cannot be lifted free of the stops 32, and therefore cannot inadvertently be pivoted downward out of the vertical position.

Figure 10:
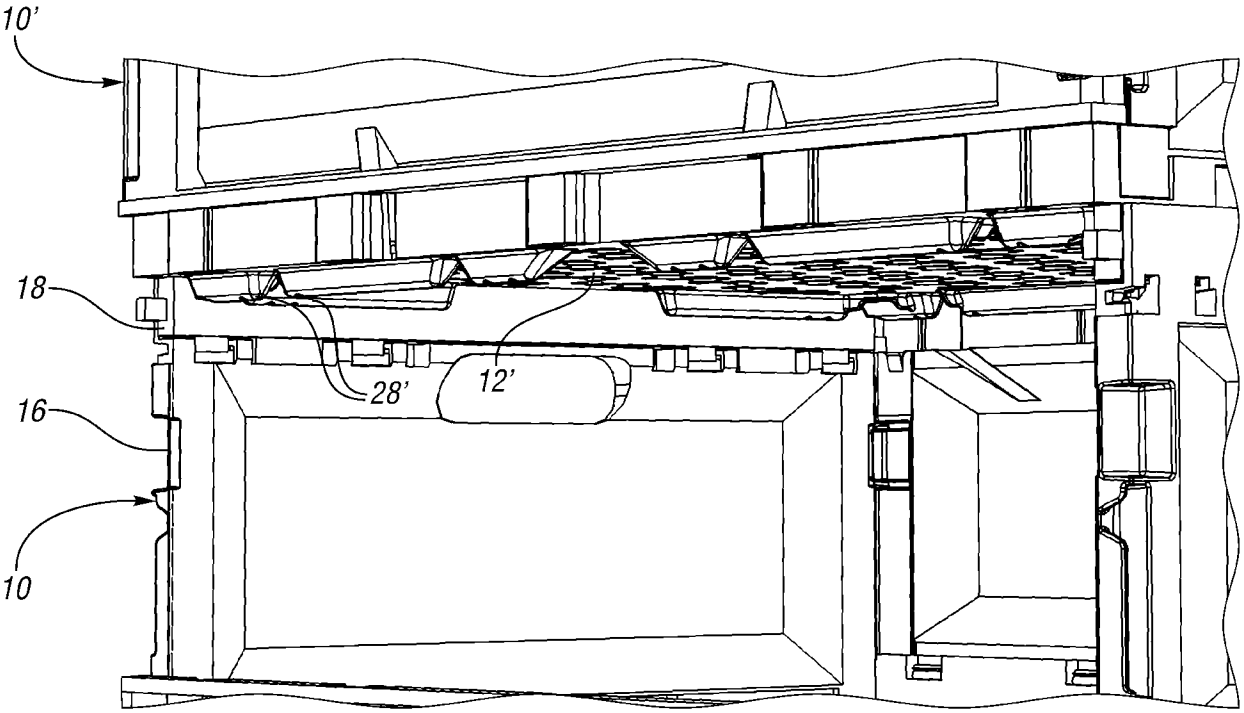
FIG. 10 is a perspective view showing the stacked containers of FIG. 8 with one of the side walls of the lower container removed for purposes of illustration.

FIG. 10 is a perspective view showing the stacked containers 10, 10' with one of the side walls 14 of the lower container 10 removed for purposes of illustration. Again, it can be seen that the base 12' of the upper container 10' is supported on the support 18 of the lower container 10. The feet 28' of the upper container 10' are received within the periphery of the walls 14, 16.

Figure 11:
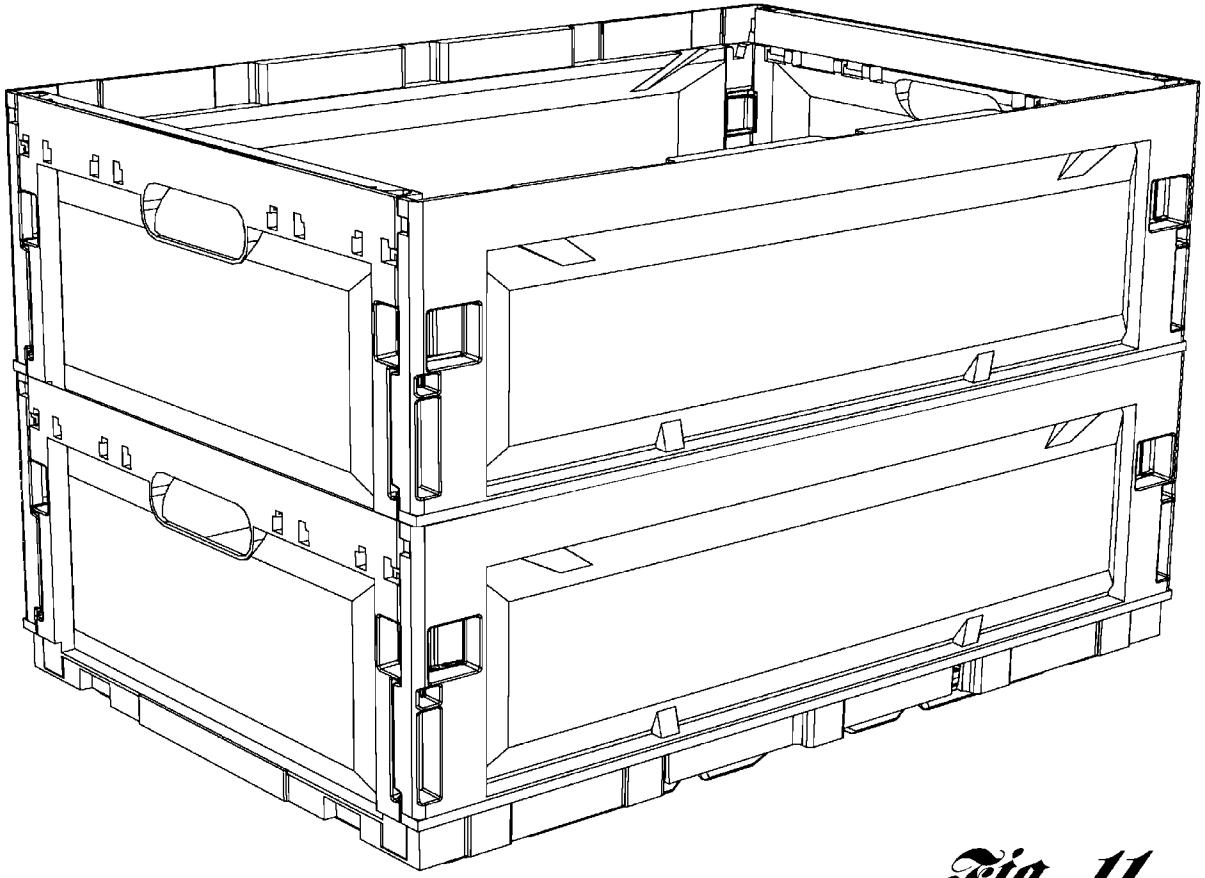
FIG. 11 shows the identical container stacked on the container of FIG. 1 in a low stack position.

As shown in FIG. 11, when the supports 18 are pivoted to the horizontal or extended position (FIG. 5), the upper container 10' stacks on the lower container 10 at a lower height. The base 12' (not visible) of the upper container 10' fits within the periphery of the walls 14, 16 of the lower container 10, thus, by pivoting the supports 18 between the two positions, stacking height of the two containers 10, 10' can be changed by a given amount, in this example, approximately 30 mm. In this manner, depending upon the height of the goods in the container 10, the appropriate stacking height can be chosen. If the lower stacking height can be used, the overall stacking height of the containers 10, 10' (and several more containers in the stack) can be reduced significantly, thereby increasing the efficiency of the storage.

Figure 12:
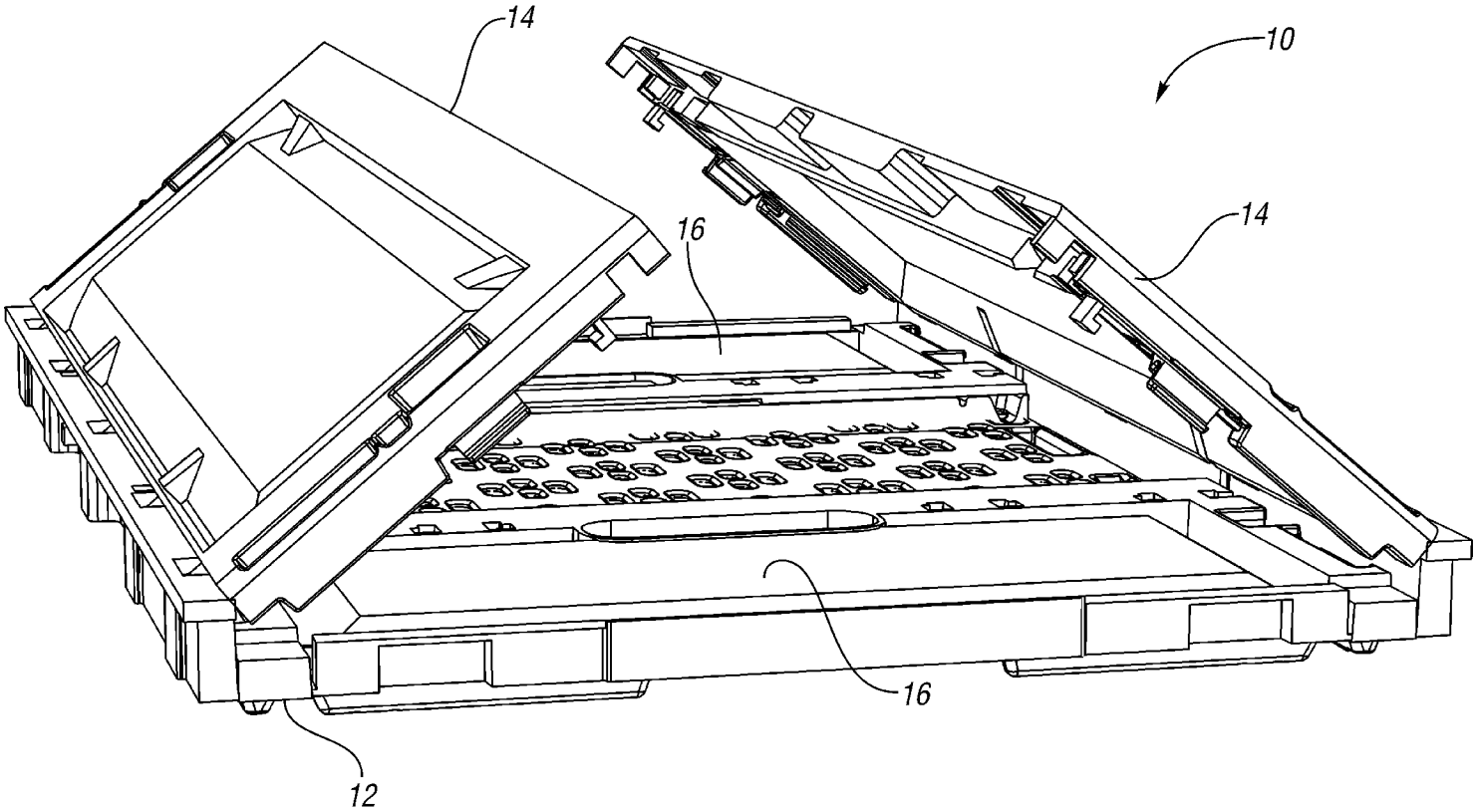
FIG. 12 shows the container of FIG. 1 being moved toward a collapsed position.

Referring to FIG. 12, when the container 10 is empty, the end walls 16 can be collapsed onto the base 12 and the side walls 14 can be collapsed onto the end walls 16 and base 12. The empty container 10 can be returned for reuse.

Generally, compared to existing containers 10, the recesses 22 formed in the base and the recesses 24 formed in the upper portion of the walls permit the base 12 of one container 10 to nest within the upper portion of the walls of another, but the projections 20 in the base 12 house the hinges which attach the walls 14, 16 to the base 12.

Figure 13:
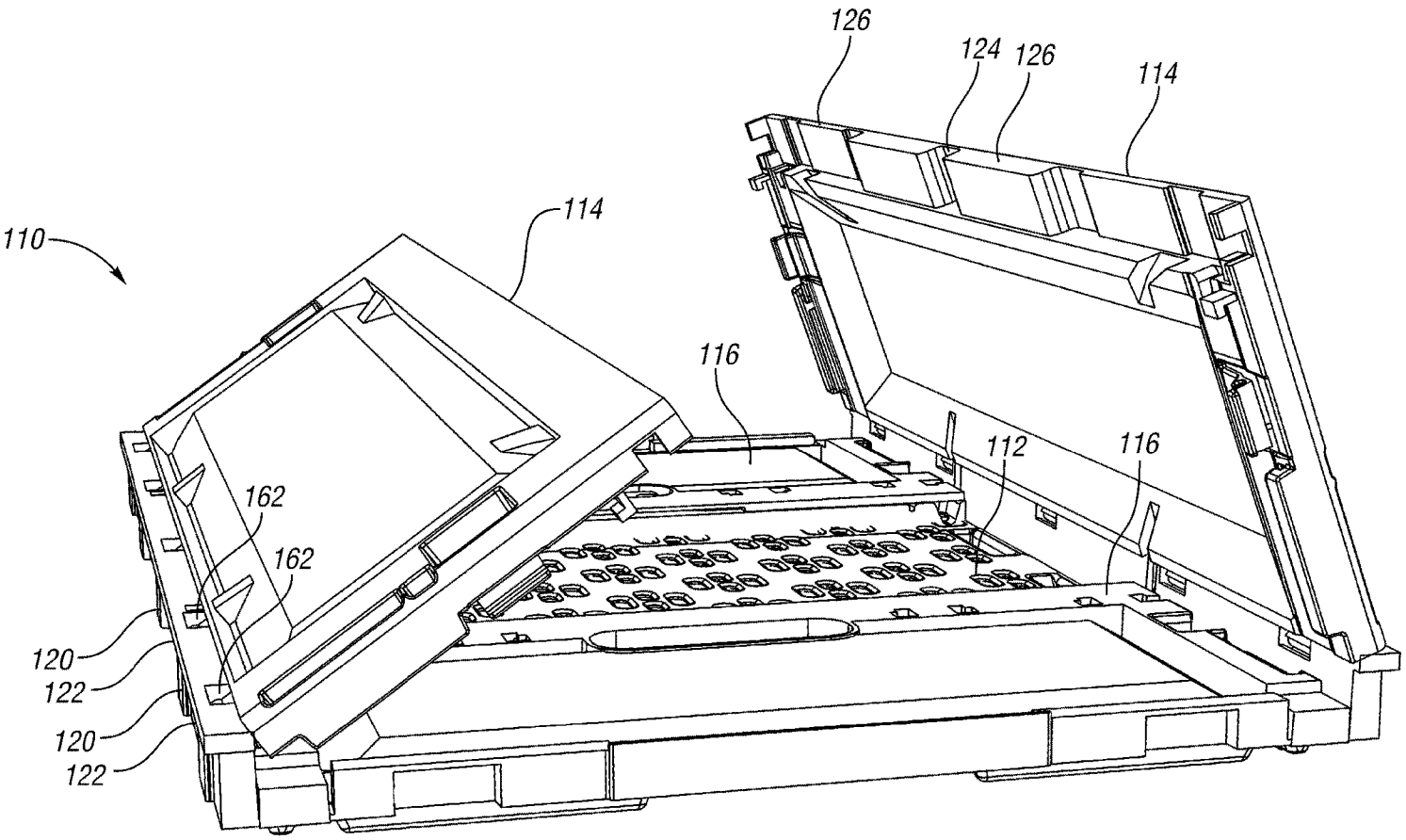
FIG. 13 is a perspective view of a collapsible container according to a second embodiment being moved toward a collapsed position.

FIGS. 13-28 illustrate a container 110 according to a second embodiment of the present invention. The container 110 includes a base 112 having side walls 114 or long walls pivotably connected to side edges of the base 112 and end walls 116 or short walls pivotably connected to end edges of the base 112. The outer periphery of the base 112 includes a plurality of projections 120 alternating with recesses 122. Similarly, the interior periphery of the upper edge of the side walls 114 includes alternating recesses 124 and projections 126 complementary to projections 120 and recesses 122 on the base 112. FIG. 13 is a perspective view of the container 110 with the end walls 116 collapsed on the base 112 and the side walls 114 in the process of being collapsed. The recesses 122 formed in the base and the recesses 124 formed in the upper portion of the walls permit the base 112 of one container 110 to nest within the upper portion of the walls of another, but the projections 120 in the base 112 house the hinges 162 which attach the walls 114, 116 to the base 112

Figure 14:
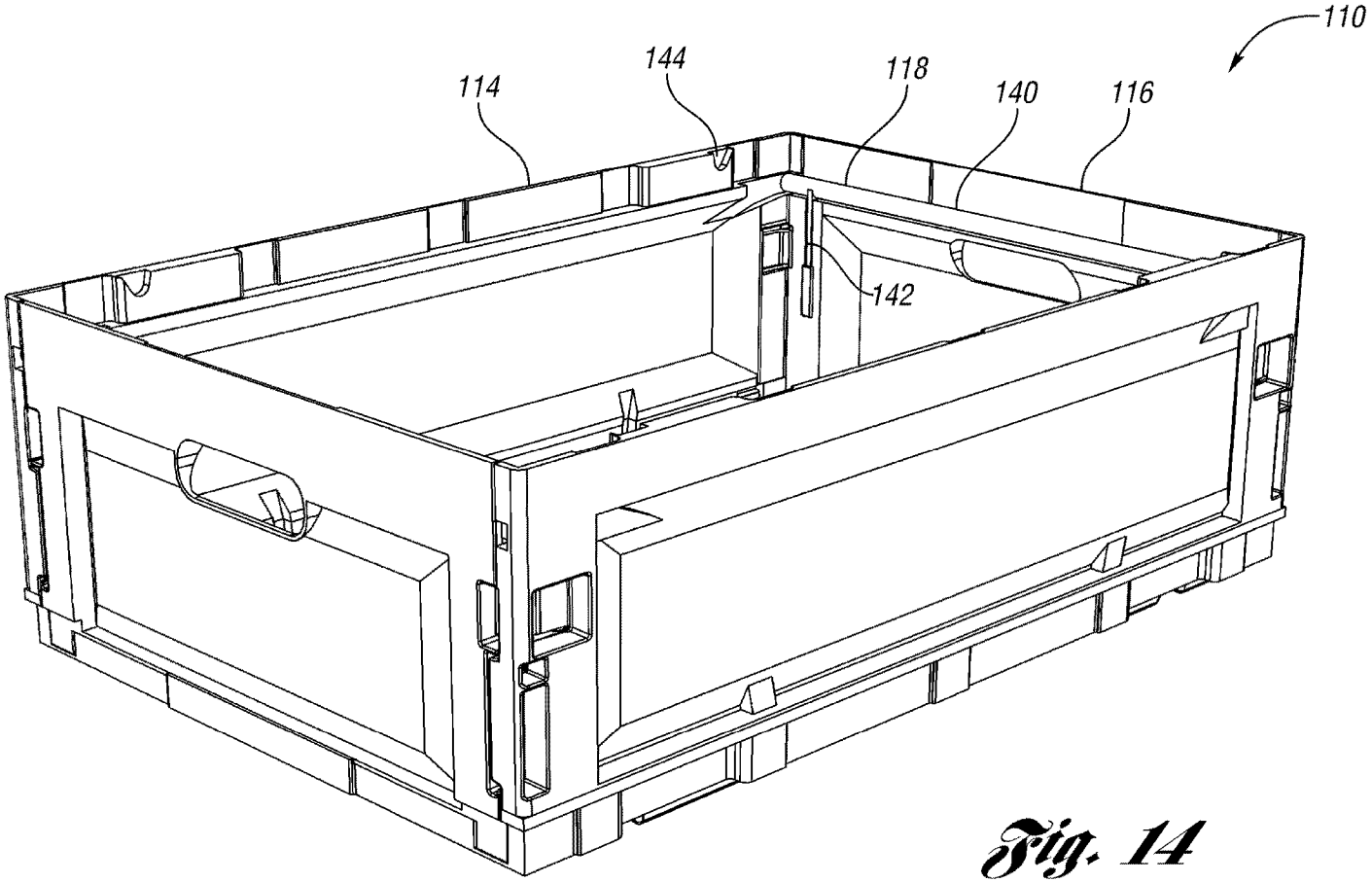
FIG. 14 shows the container of FIG. 13 in an upright, assembled, use position.

FIG. 14 is a perspective view of the container 110 in the assembled position. The container 110 further includes a pair of supports 118 pivotably connected to the end walls 116. Each support 118 includes a support portion 140 extending across the width of the container 110. The support portion 140 is pivotably connected to the end wall 116 by a pair of arms 142. The side walls 114 include support surfaces defined in recesses 144.

Figure 15:
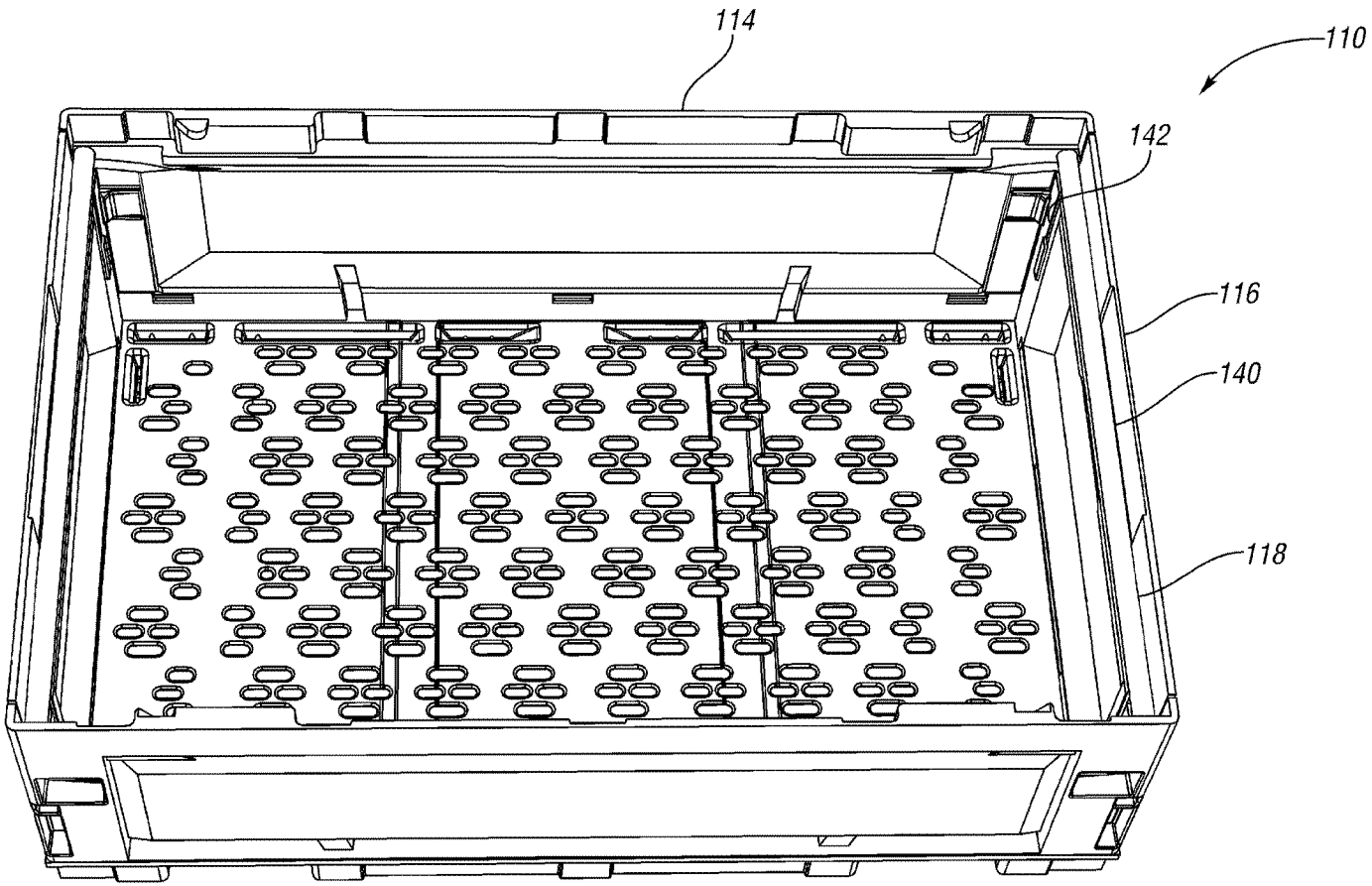
FIG. 15 is an upper perspective view of the container of FIG. 14.
Figure 16:
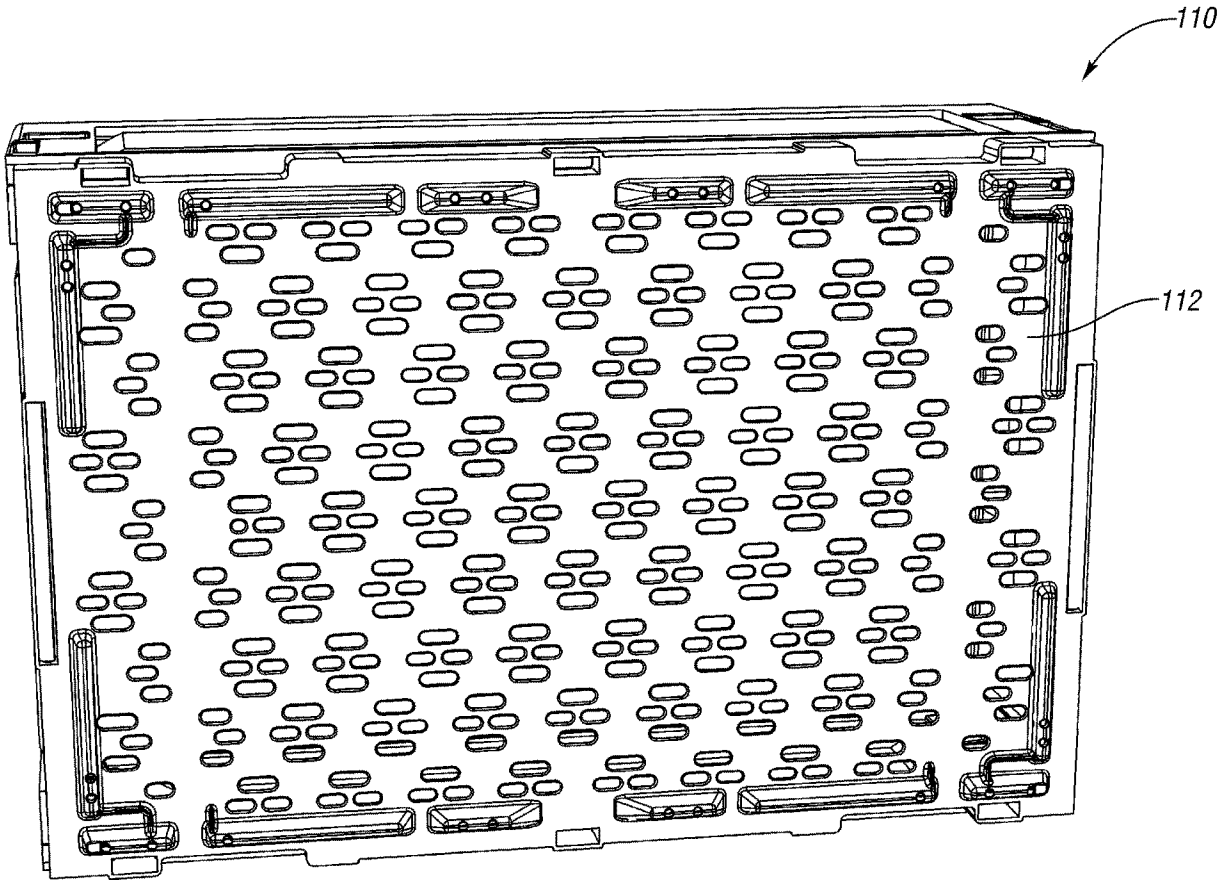
FIG. 16 is a bottom perspective view of the container of FIG. 14.
Figure 17:
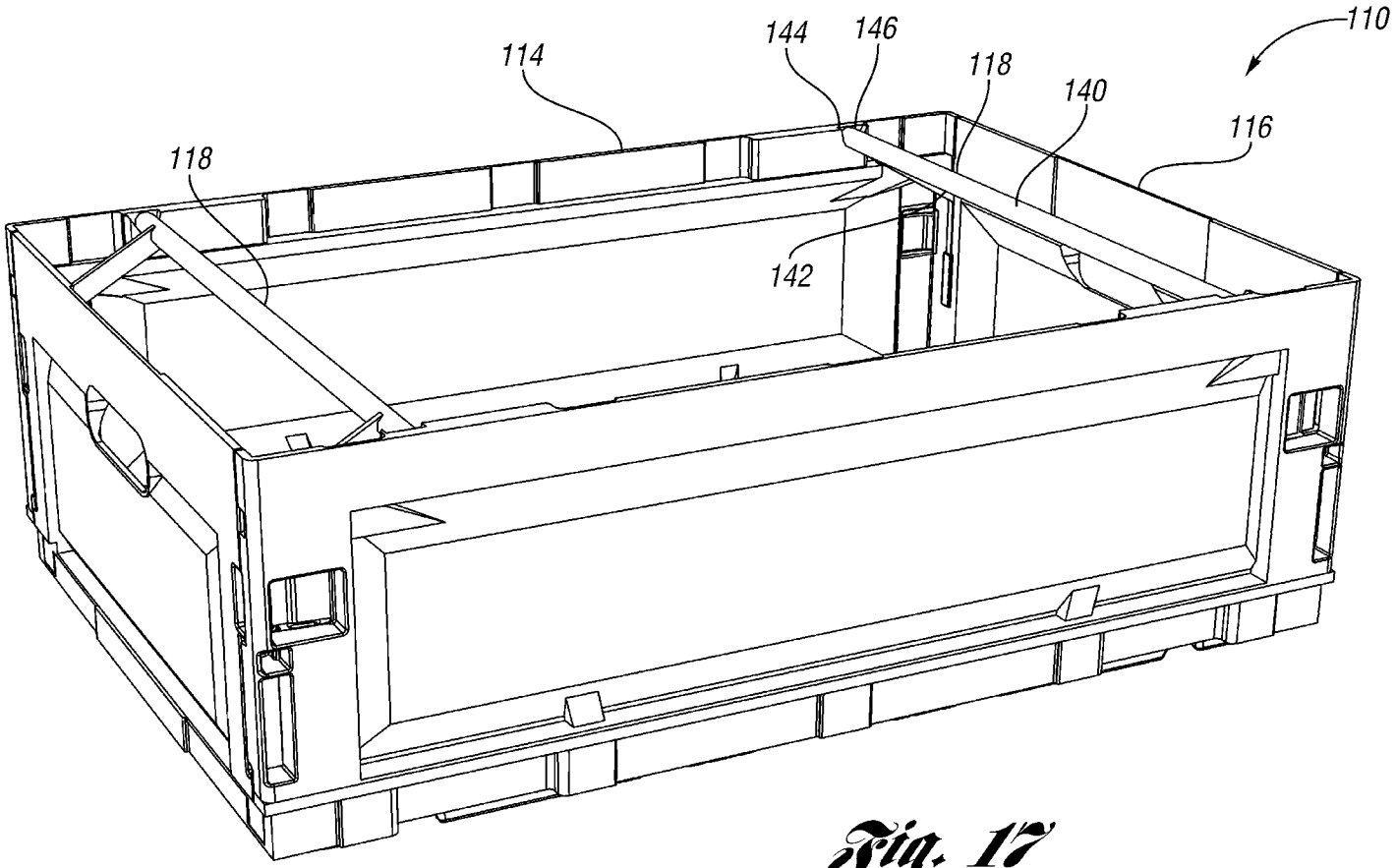
FIG. 17 shows the container of FIG. 14 with the supports in the support position.

FIG. 15 is an upper perspective view of the container 110. FIG. 16 is a bottom perspective view of the container 110. FIG. 17 shows the supports 118 in a deployed or extended position. The arms 142 pivot and slide relative to the end wall 116 to the upper position as shown. The support portion 140 is extended into the mouth of the container, away from the adjacent end wall 116, with an end portion of the support portion 140 received in the recess 144 on each adjacent side wall 114.

Figure 18:
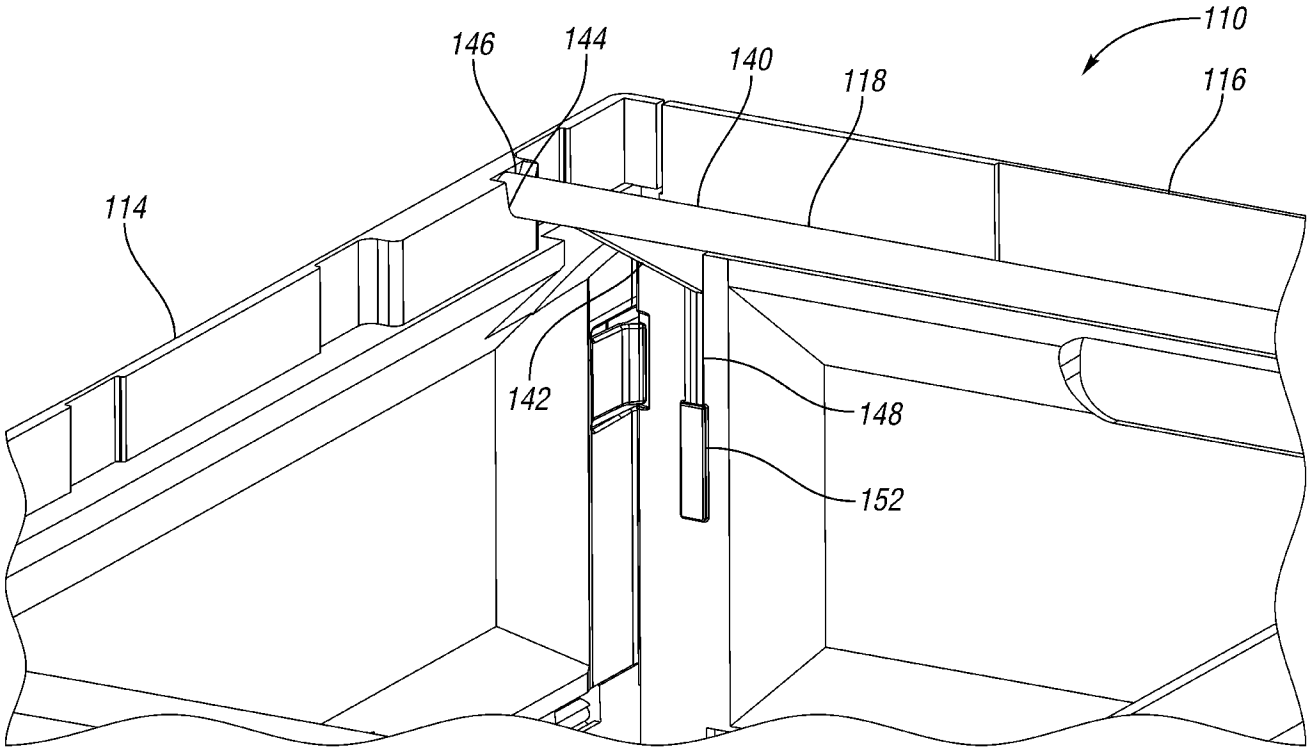
FIG. 18 is an enlarged interior view of one corner of the container of FIG. 17.

As can be seen in FIG. 18, the end wall 116 includes a slot 148 in which the arm 142 of the support 118 is received. The arm 142 pivots and slides within the slot 148 of the end wall 116. A lower cap 152 partially covers the slot 148 to help retain the support 118 in the home or retracted position (FIG. 15).

Figure 19:
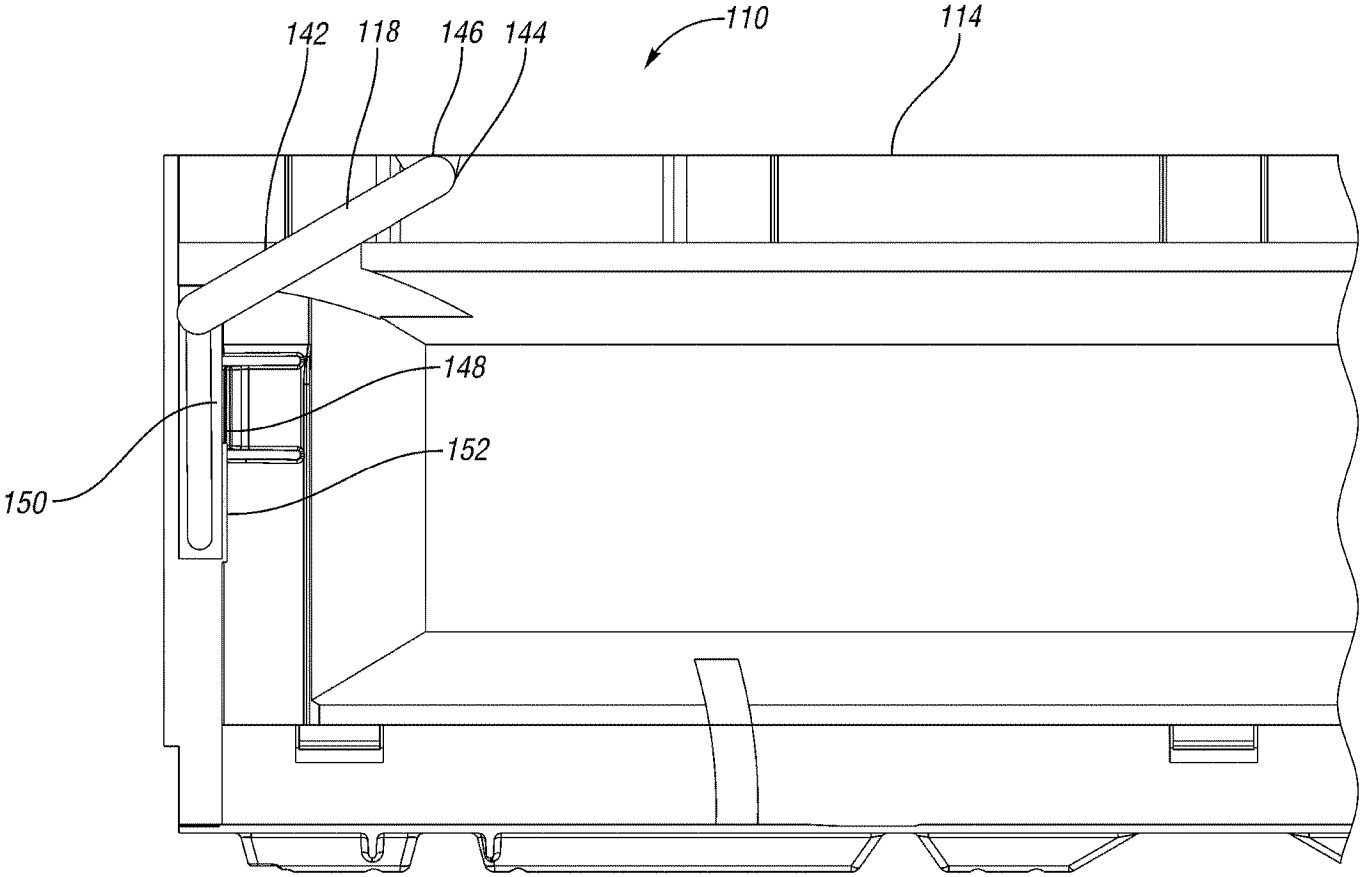
FIG. 19 is a section view through the slot of FIG. 18.

FIG. 19 is a section view through the slot 148. As shown, there is also a vertical slot 150 opening laterally in the end wall 116 in which a pin (not visible) at the lower end of the arm 142 is received.

Figure 20:
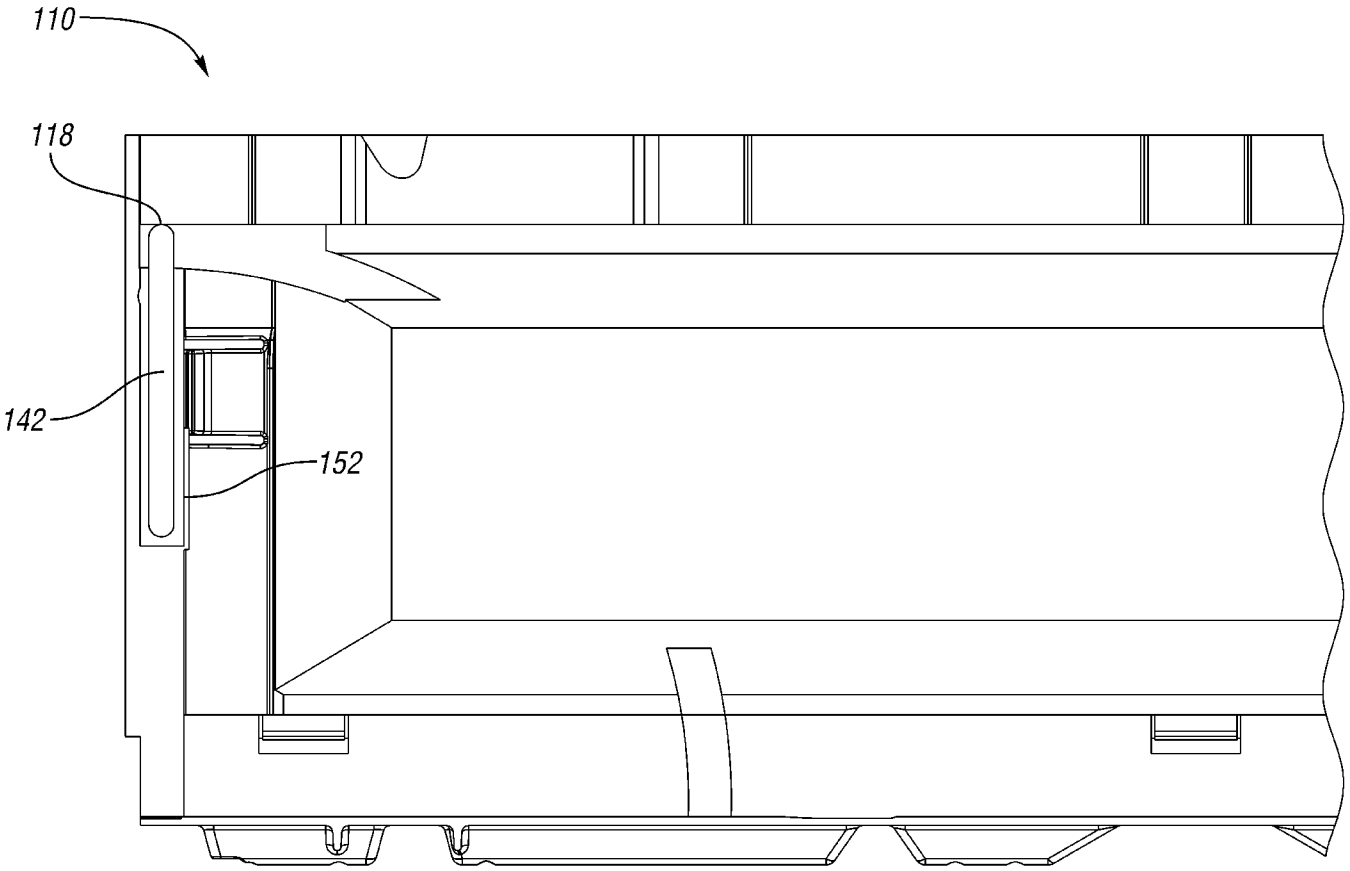
FIG. 20 shows the support of FIG. 19 in the retracted or home position.

FIG. 20 shows the support in the retracted or home position, with the arm 142 retained behind the lower cap 152.

Figure 21:
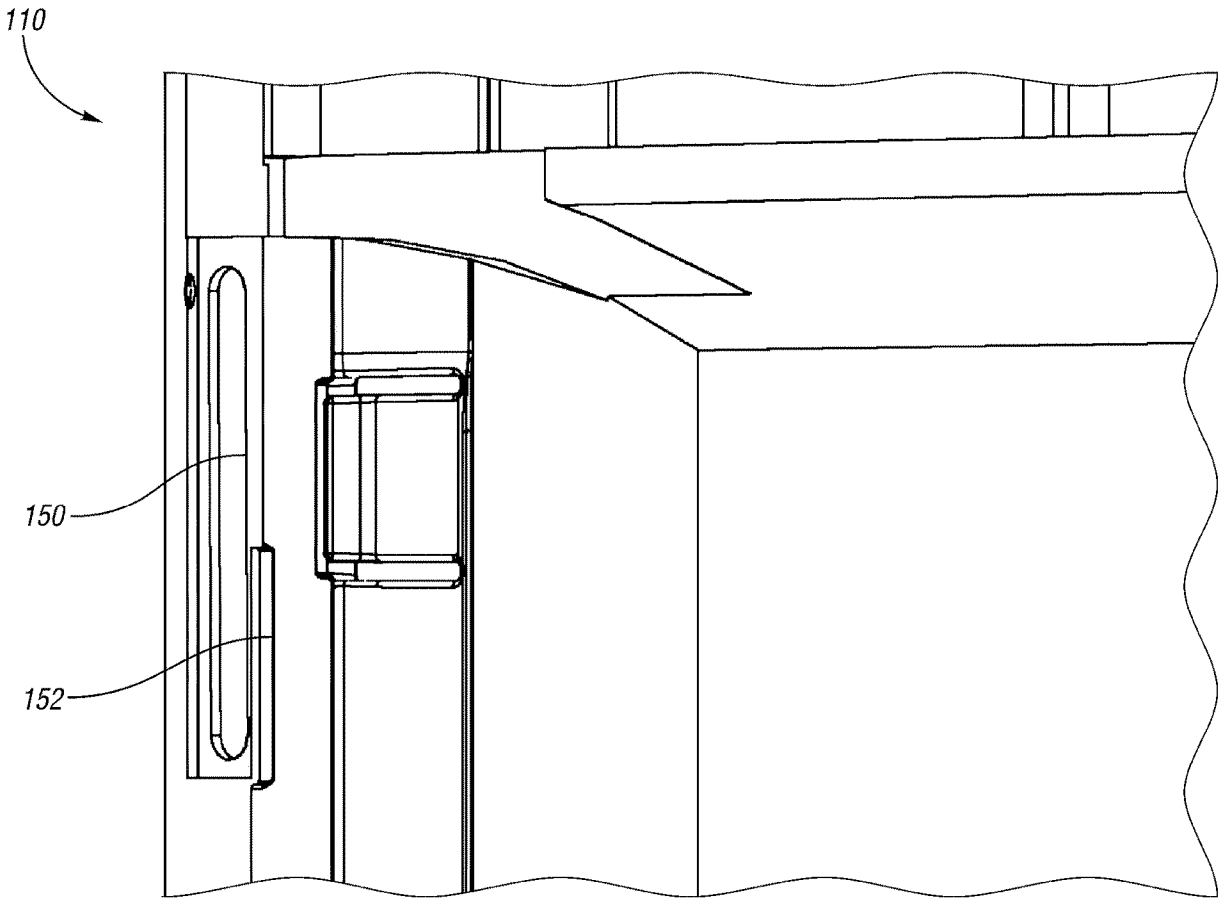
FIG. 21 illustrates the vertical slot of and lower cap of FIG. 20 with the support removed.

FIG. 21 illustrates the vertical slot 150 and lower cap 152 with the support 118 removed.

Figure 22:
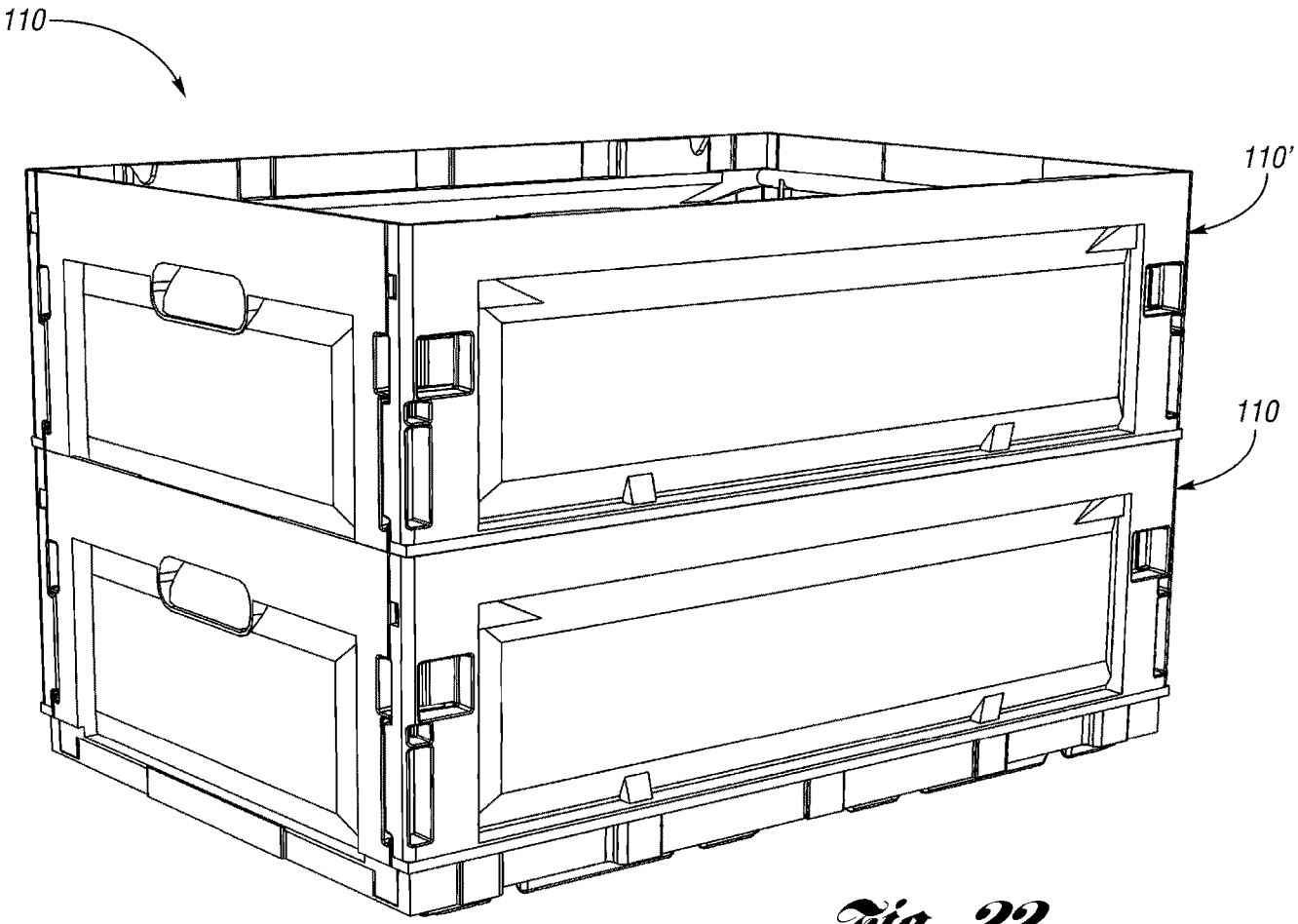
FIG. 22 illustrates the container of FIG. 14 with an identical container stacked thereon in a low stack position with the supports in the home or retracted position.

FIG. 22 illustrates the container 110 with a similar container 110' stacked thereon with the supports 118 (not visible) in the home or retracted position. In this position, the base of the upper container 110' is received within the walls of the lower container 110.

Figure 23:
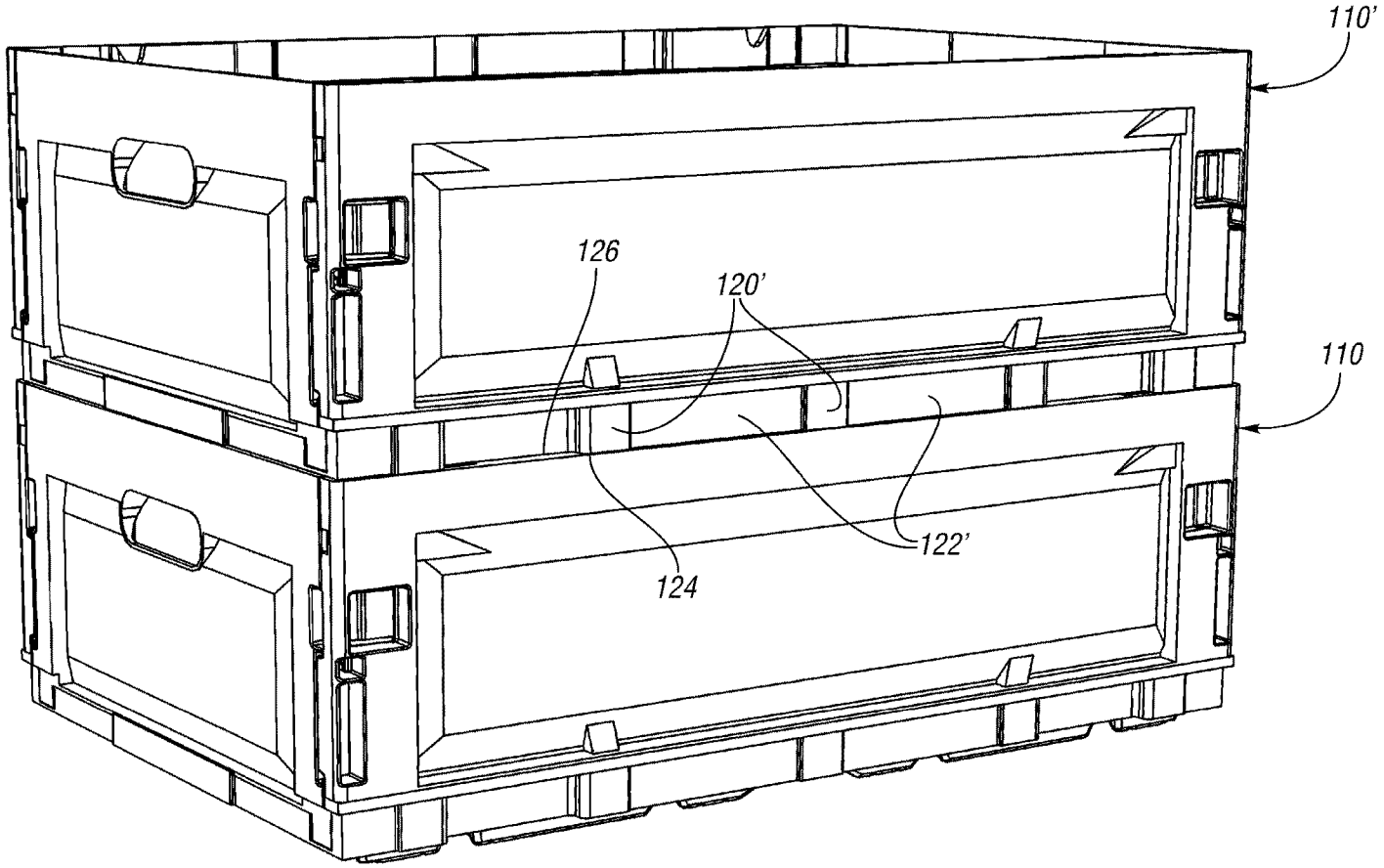
FIG. 23, shows the containers of FIG. 22 stacked on the lower container in the high stack position with the supports in the extended, support position.
Figure 24:
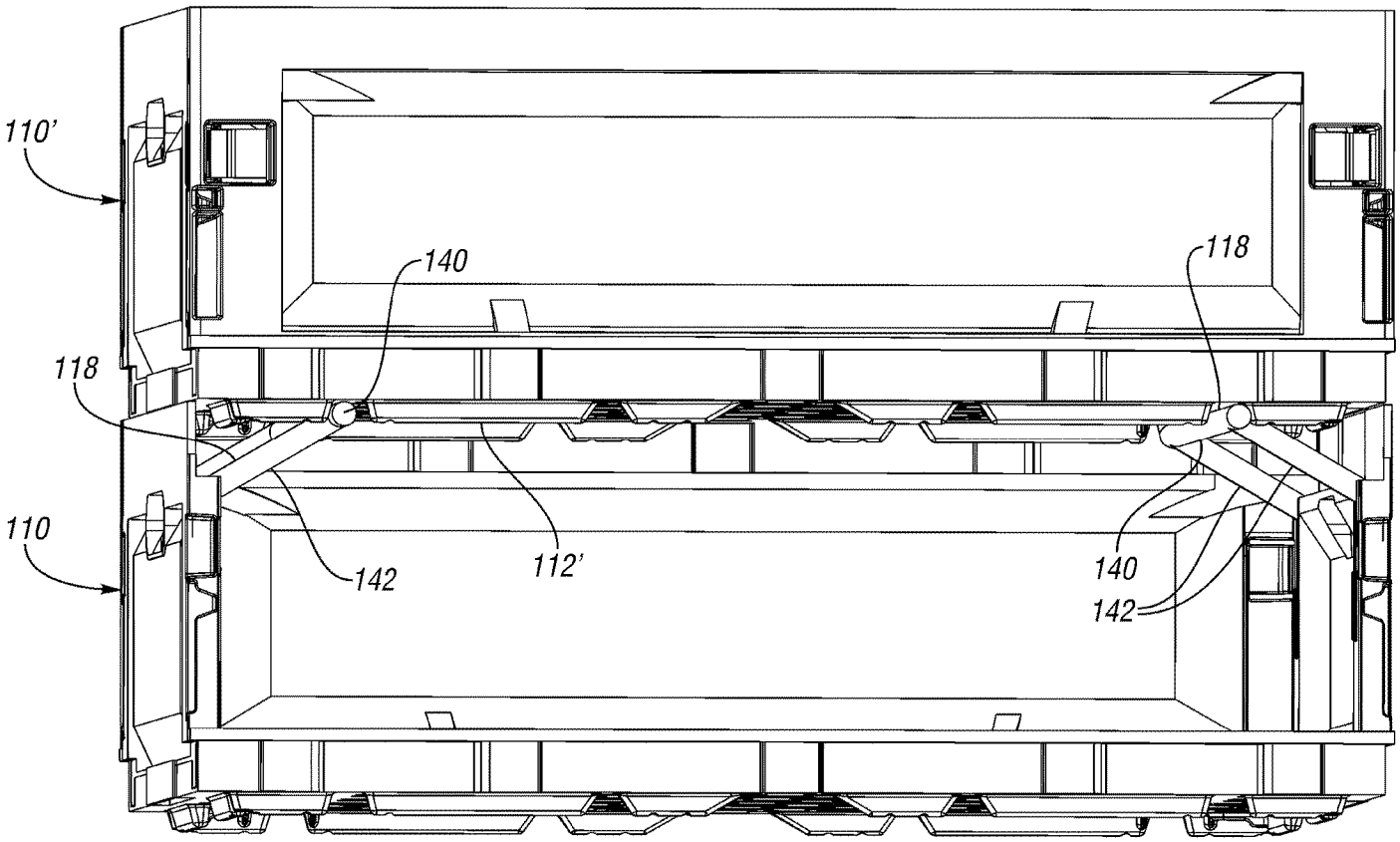
FIG. 24 is a section view through the containers of FIG. 23.

In FIG. 23, shows the upper container 110' stacked on the lower container 110 with the supports 118 (not visible) in the extended, support position. FIG. 23 also shows the alignment of the projections 120' and recesses 122' of the upper container 110' with the recesses 124 and projections 126 of the lower container 110. FIG. 24 is a section view through the containers 110, 110'. As shown, the base 112' of the upper container 110' is supported on the support portions 140 of the supports 118.

Figure 25:
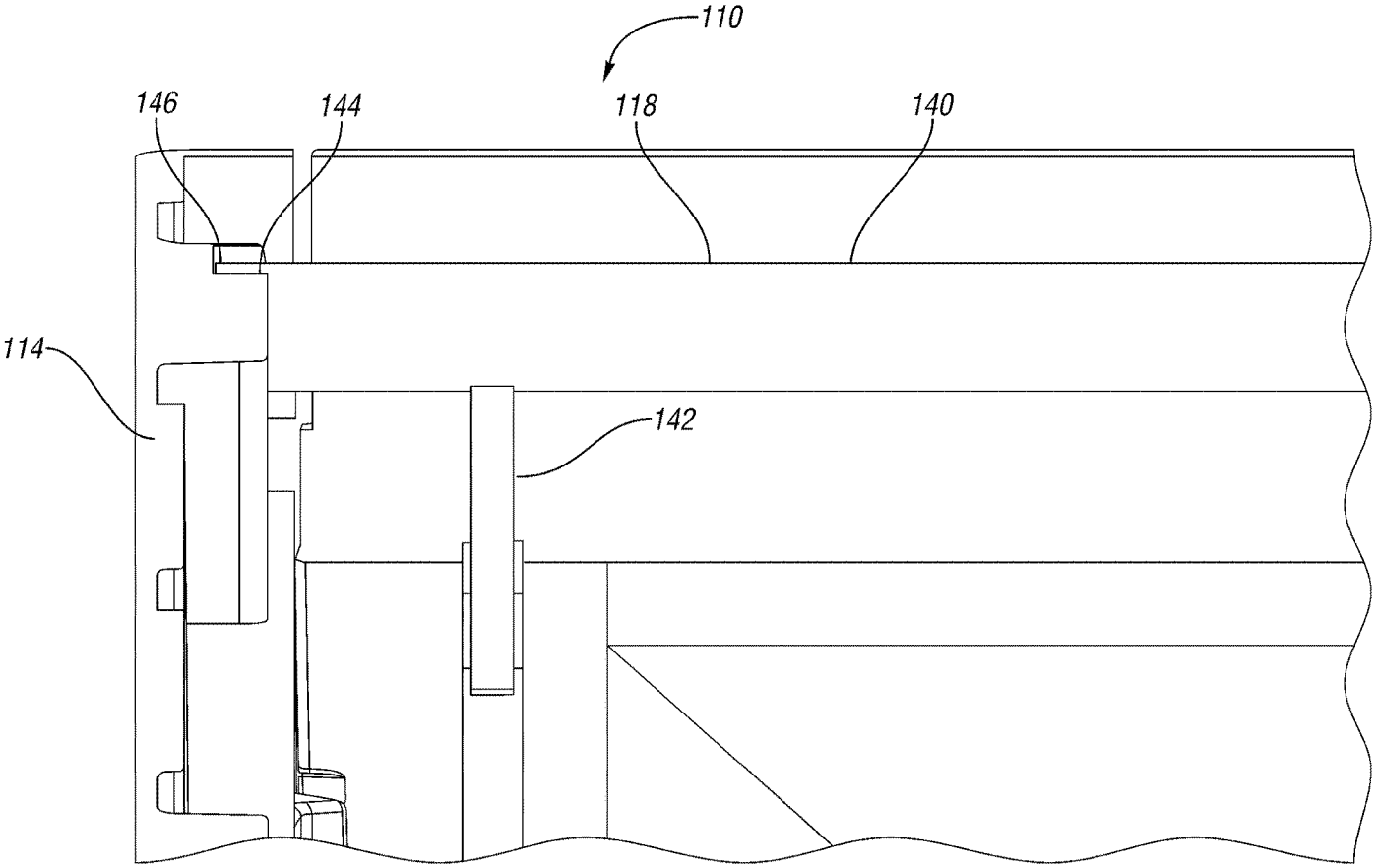
FIG. 25 is an enlarged view of the support of FIG. 24 in the extended, support position.
Figure 26:
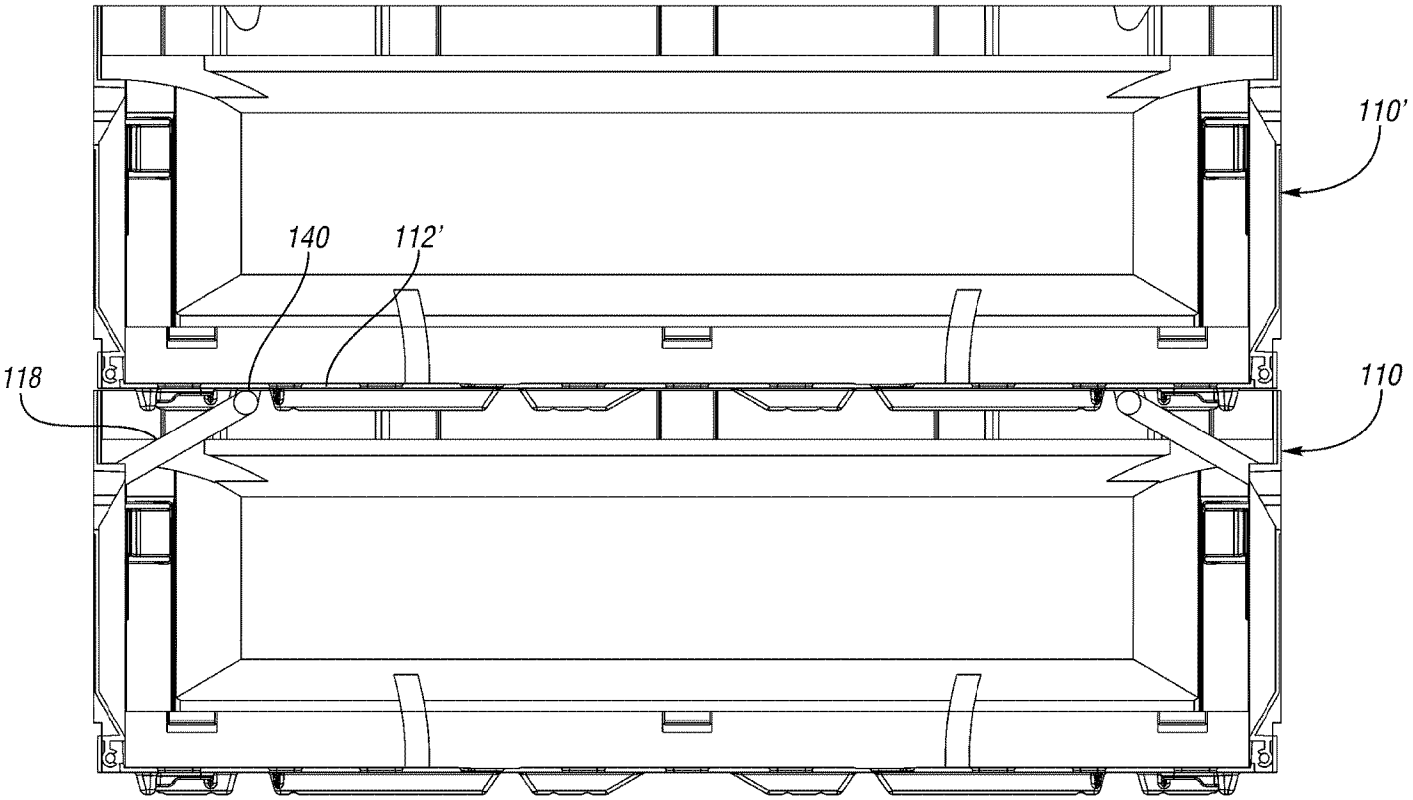
FIG. 26 is a section view through the containers of FIG. 23.

FIG. 25 is an enlarged view of the support 118 in the extended, support position. The ends 146 of the support portion 140 are received in the recesses 144 on the side walls 114. FIG. 26 is a section view through the containers 110, 110'.

Figure 27:
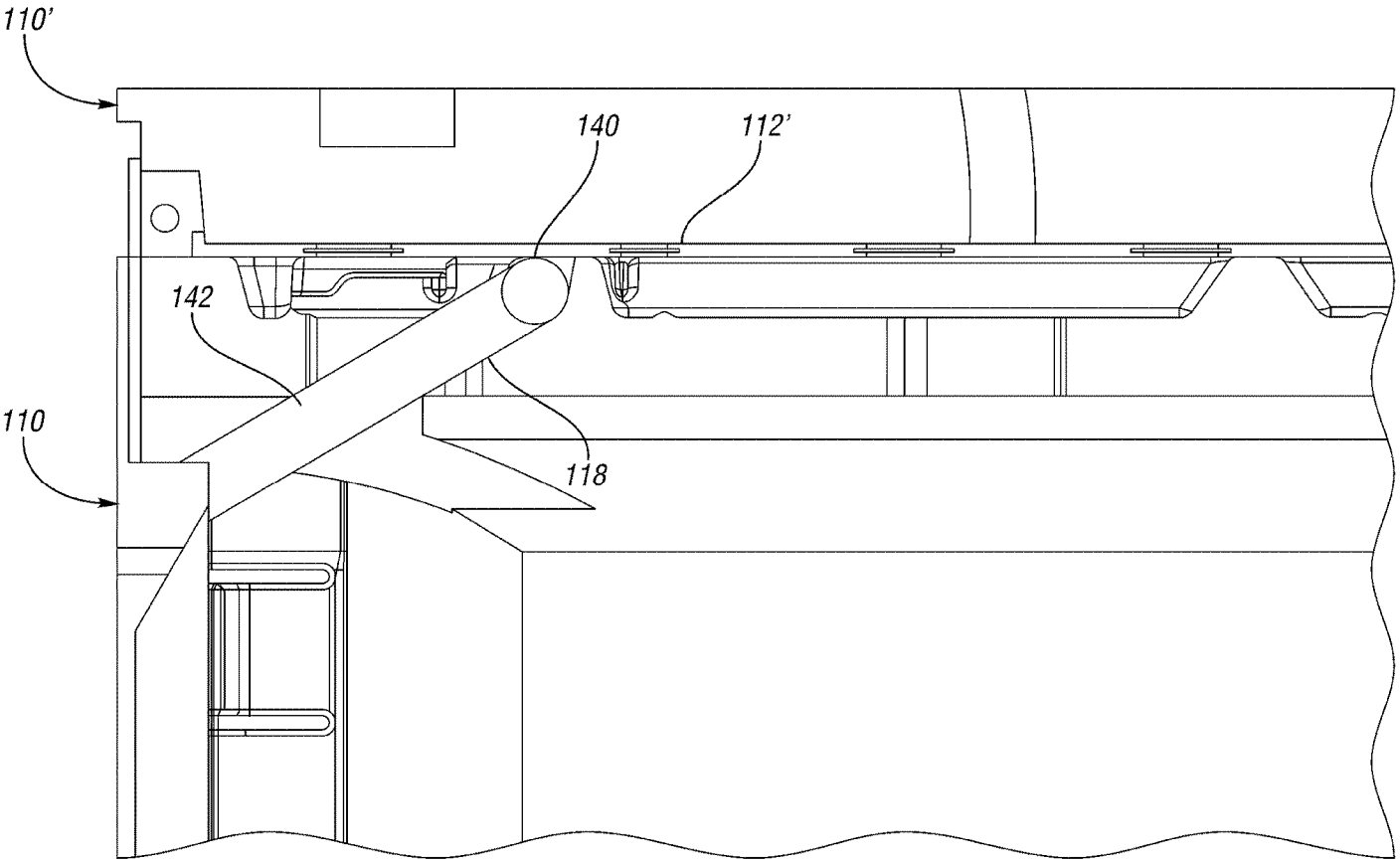
FIG. 27 is an enlarged view of a portion of FIG. 26.

FIG. 27 is an enlarged view of a portion of FIG. 26. The base 112' of the upper container 110' is supported on the support portion 140 of the support 118.

Figure 28:
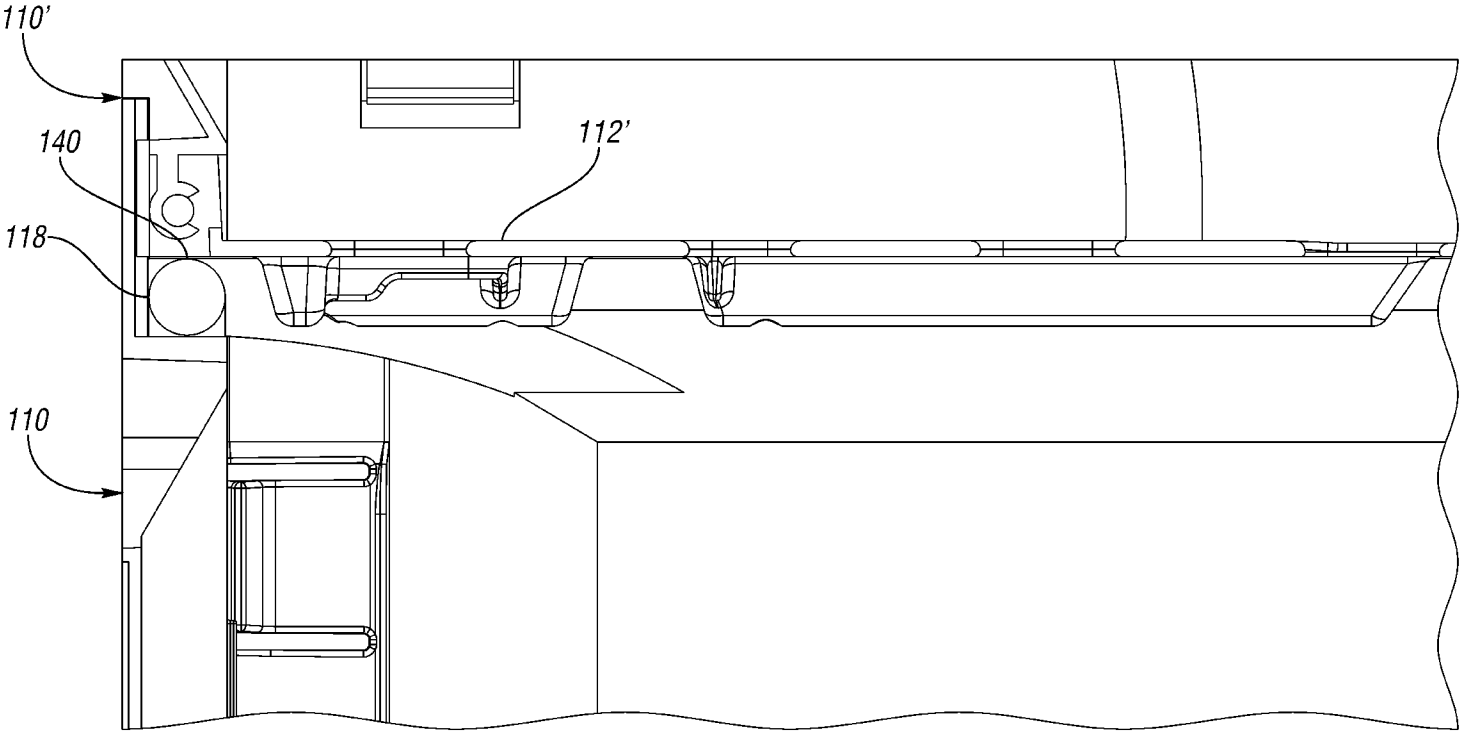
FIG. 28 is a section view similar to FIG. 27, with the support in the retracted, home position and the containers in the low stack position.

FIG. 28 is a section view similar to FIG. 27, with the support 118 in the retracted, home position. In this position, the base 112' of the upper container 110' is received within the walls of the lower container 110 at a lower height, thereby increasing the stacking efficiency when the full volume of the lower container 110 is not required.

Figure 29:
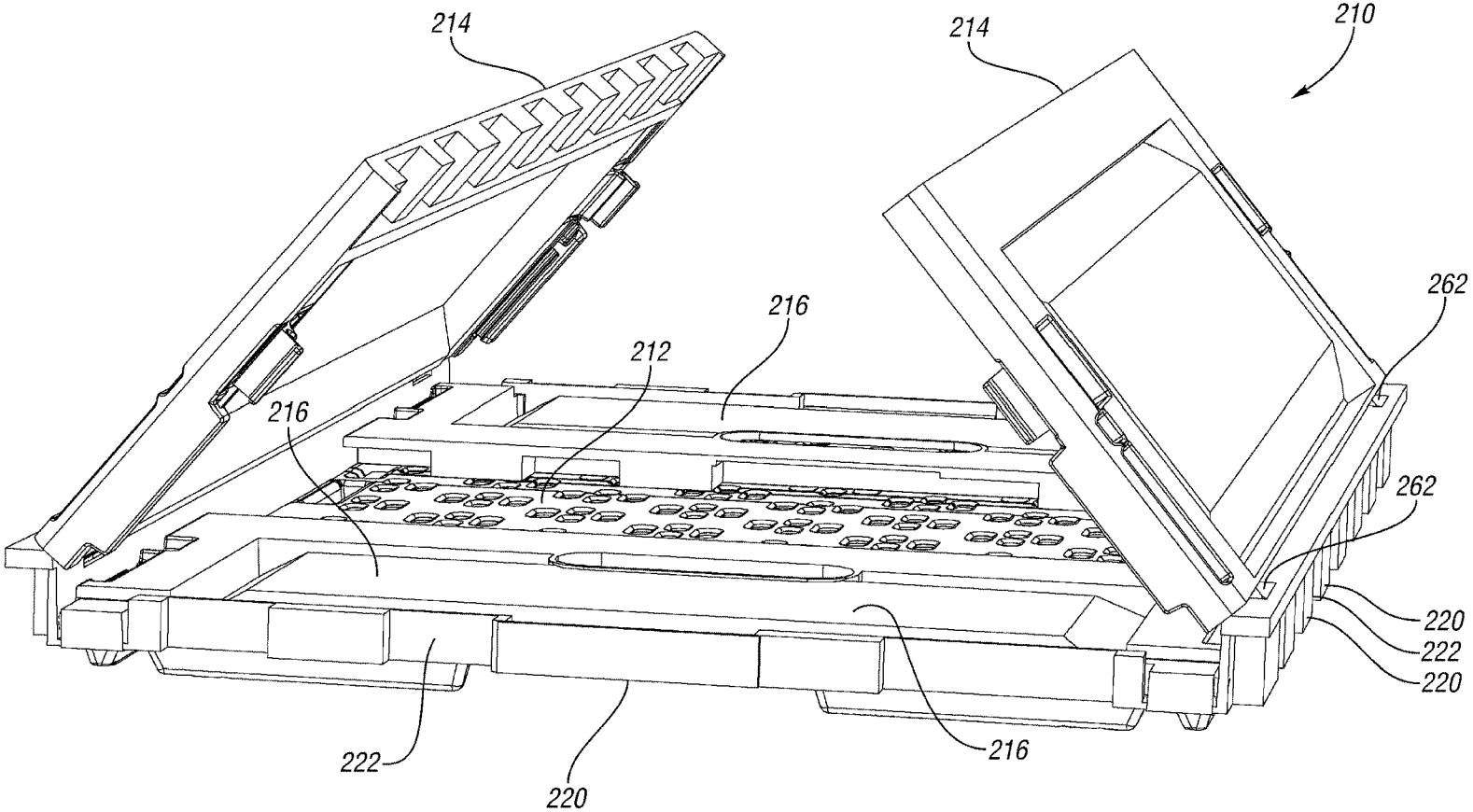
FIG. 29 is a perspective view of a collapsible container according to a third embodiment being moved toward a collapsed position.

FIGS. 29-39 illustrate a container 210 according to a third embodiment of the present invention. Referring to FIG. 29, the container 210 includes a base 212 having side walls 214 or long walls pivotably connected to side edges of the base 212 and end walls 216 or short walls pivotably connected to end edges of the base 212. The outer periphery of the base 212 includes a plurality of projections 220 alternating with recesses 222. Similarly, the interior periphery of the upper edge of the side walls 214 includes alternating recesses 224 and projections 226 complementary to projections 220 and recesses 222 on the base 212. FIG. 29 is a perspective view of the container 210 with the end walls 216 collapsed on the base 212 and the side walls 214 in the process of being collapsed. The recesses 222 formed in the base and the recesses 224 formed in the upper portion of the walls permit the base 212 of one container 210 to nest within the upper portion of the walls of another, but the projections 220 in the base 212 house the hinges 262 which attach the walls 214, 216 to the base 212

Figure 30:
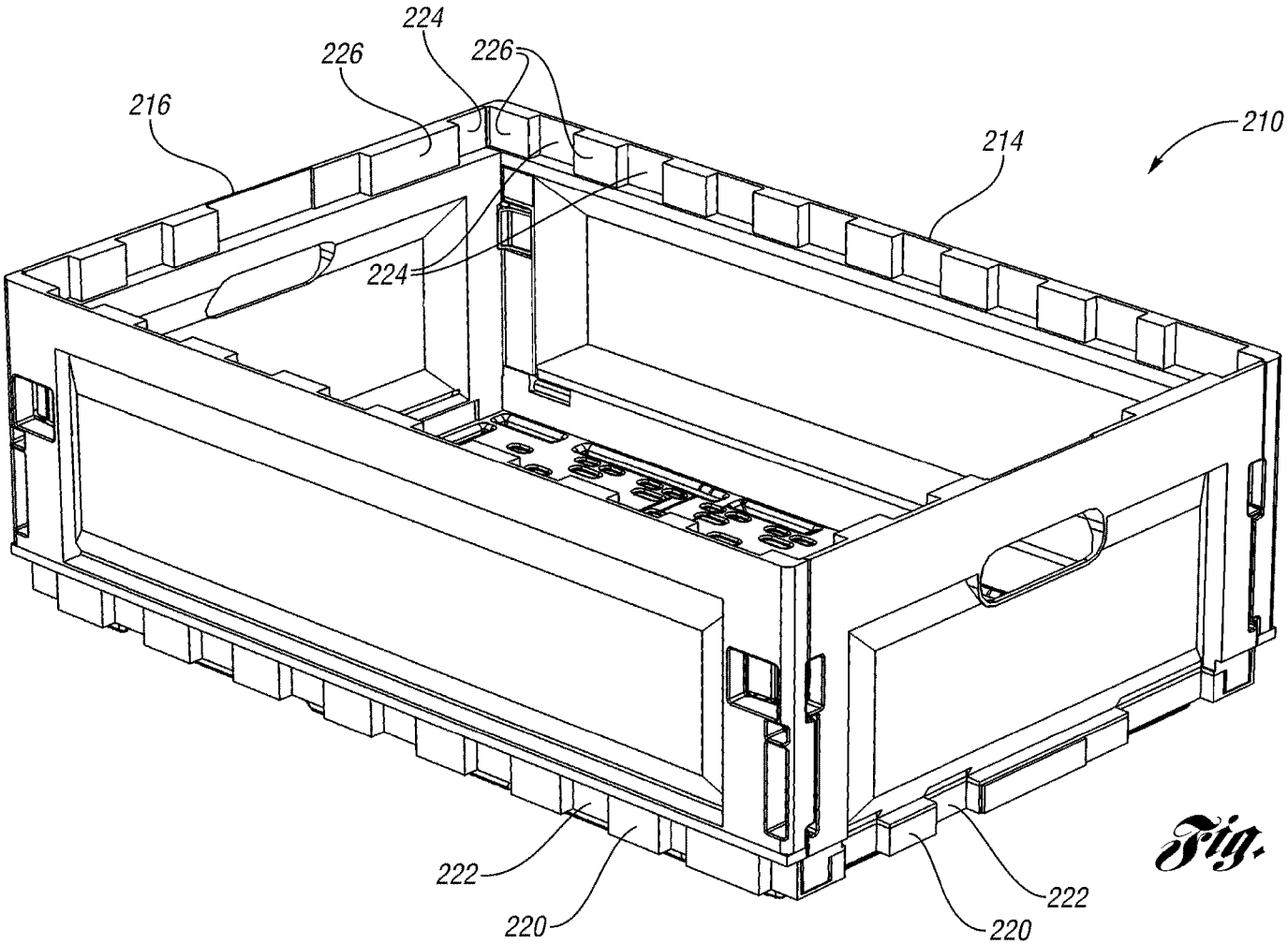
FIG. 30 shows the container of FIG. 29 in an upright, assembled, use position.
Figure 31:
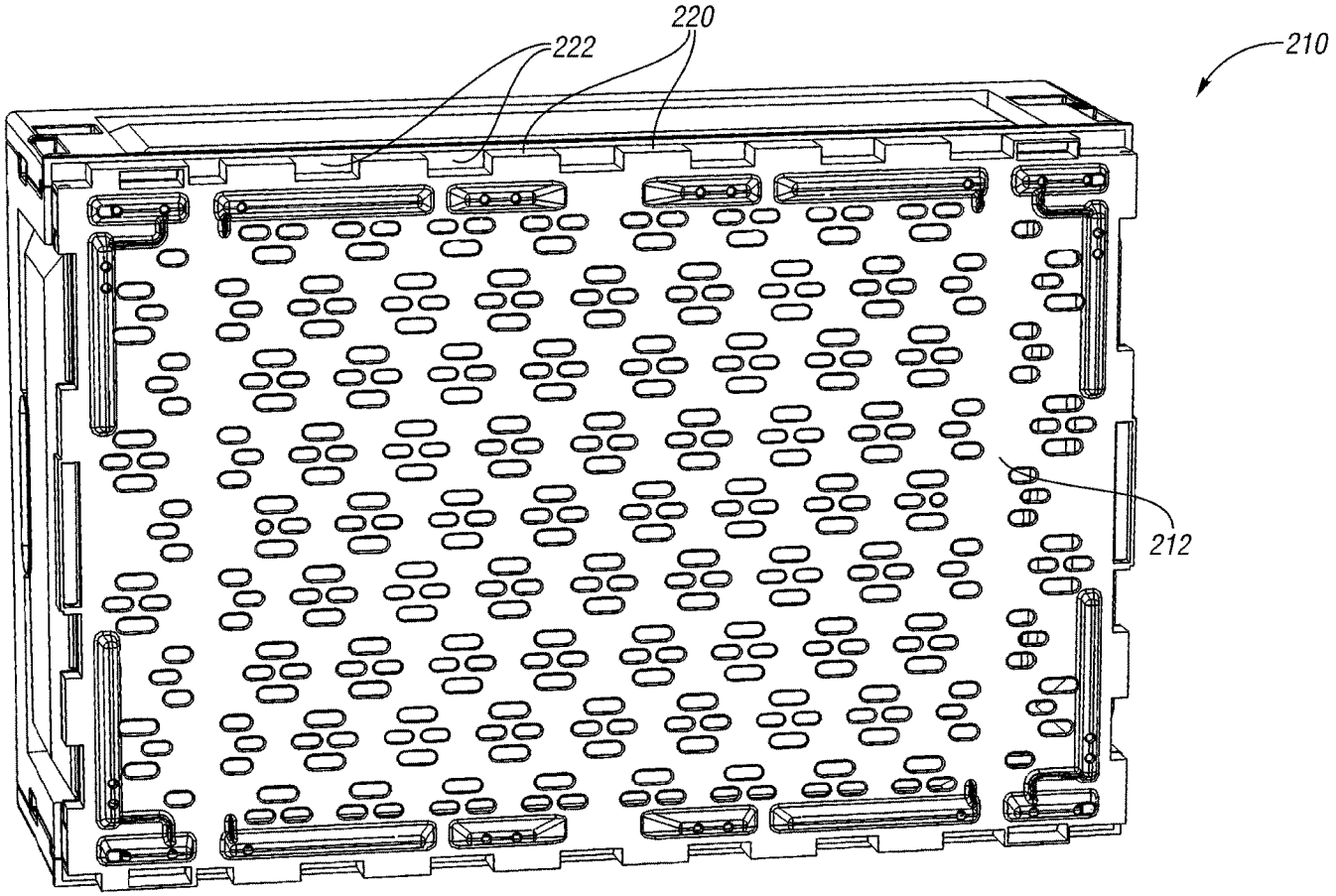
FIG. 31 is a bottom perspective view of the container of FIG. 29.
Figure 32:
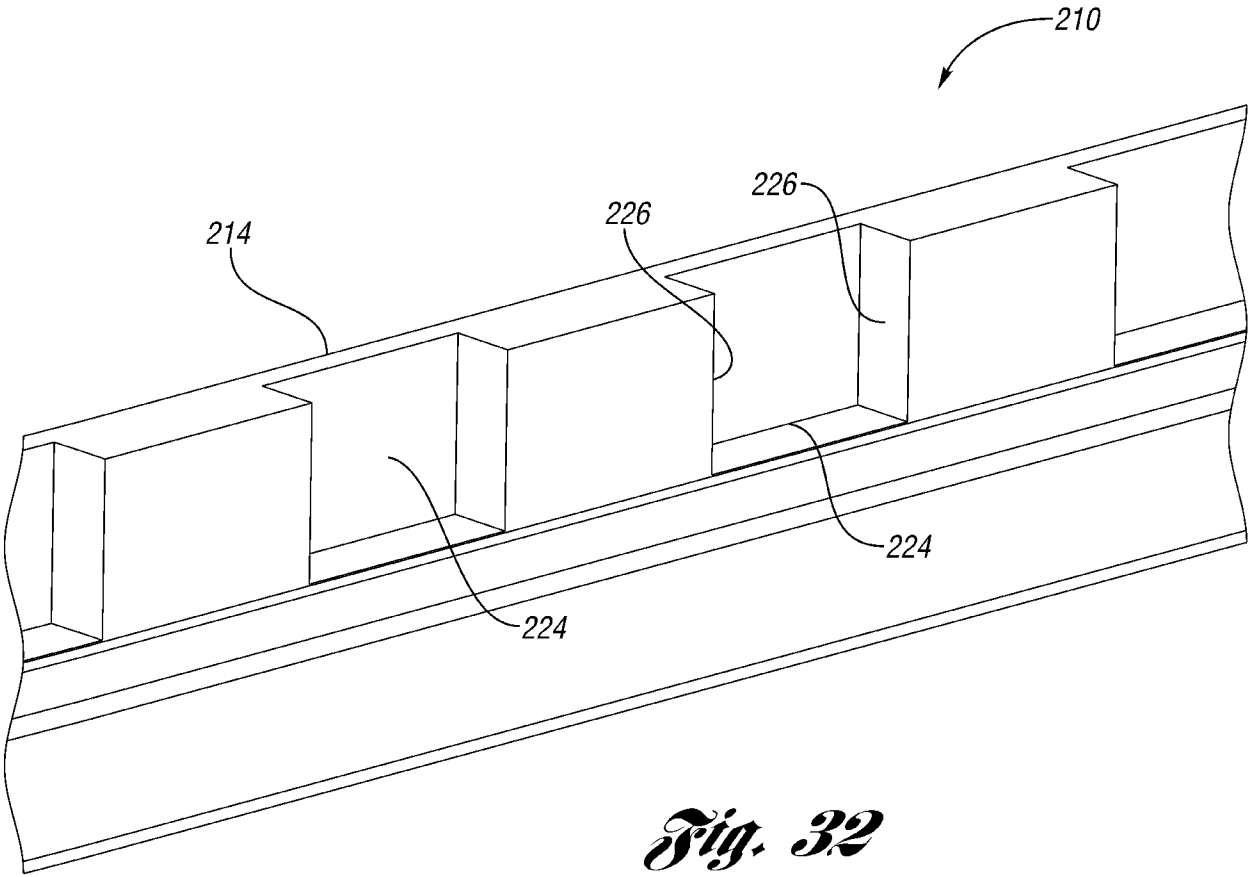
FIG. 32 is an enlarged interior view of an upper edge of one of the side walls.

FIG. 30 is a perspective view of the container 210 in the assembled position. FIG. 31 is a bottom perspective view of the container 210. FIG. 32 is an enlarged interior view of an upper edge of one of the side walls 214, showing the alternating projections 226 and recesses 224.

Figure 33:
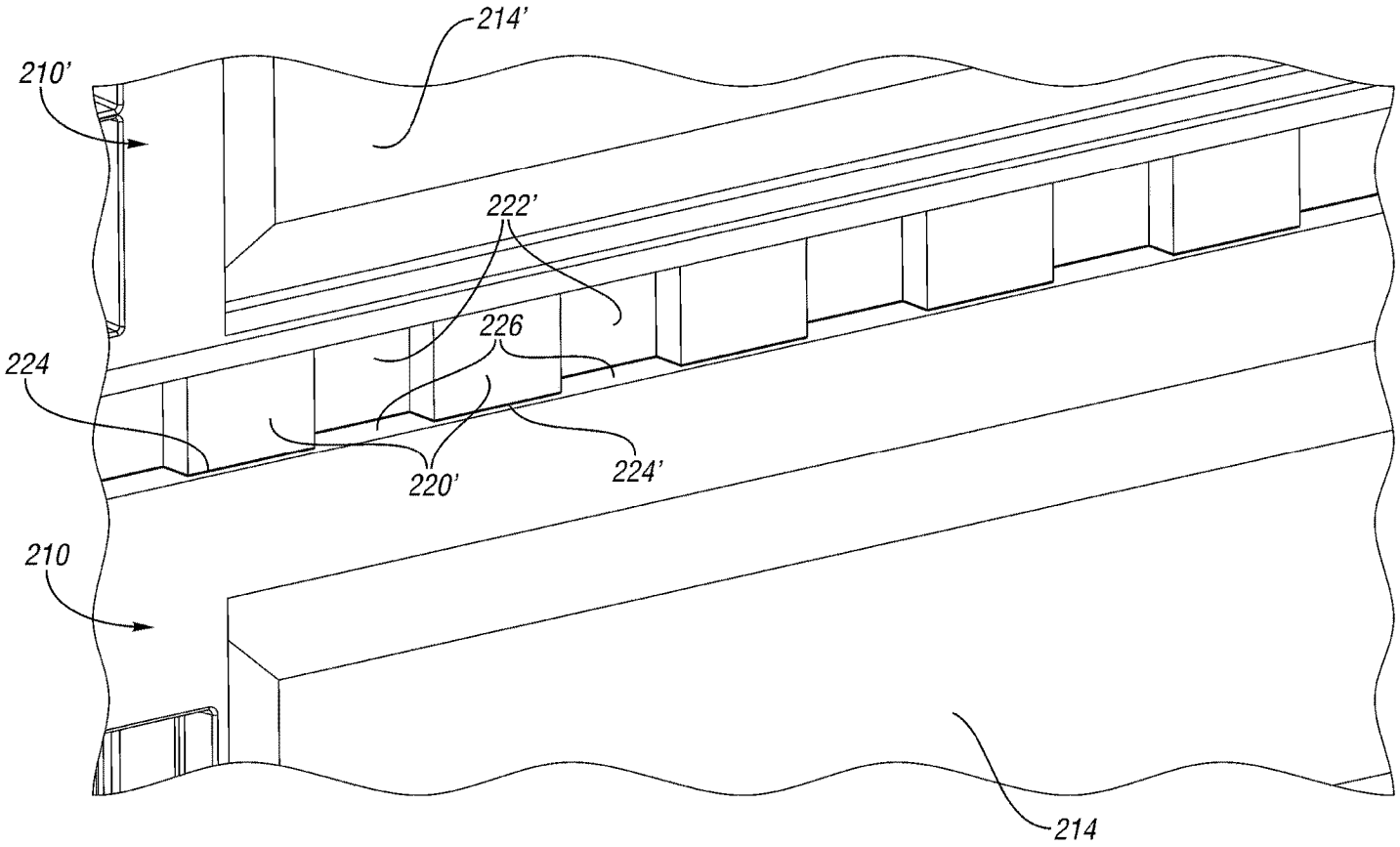
FIG. 33 is an exterior view showing the base of the upper container with the projections and recesses aligned with the recesses and projections of the upper edge of a wall of the lower container.
Figure 34:
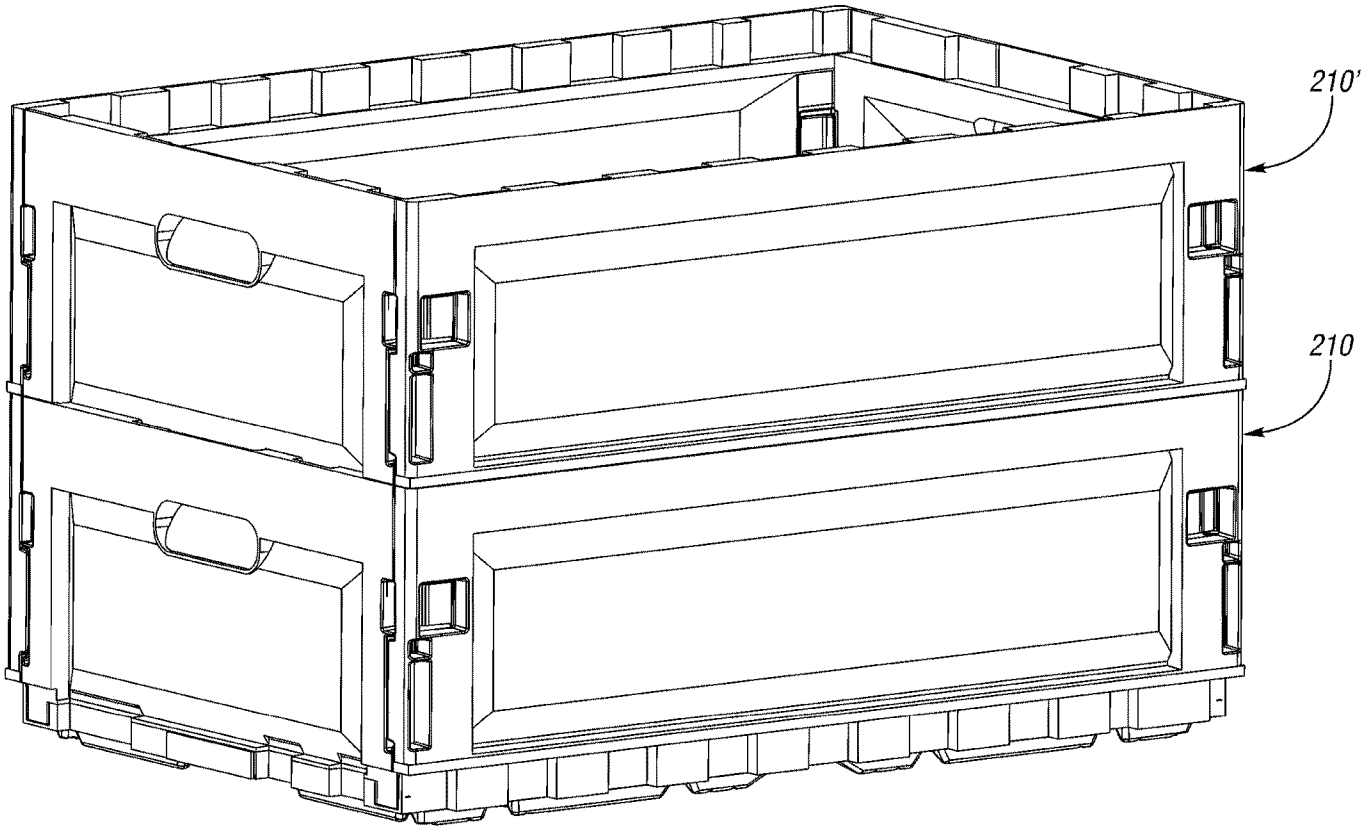
FIG. 34 shows two of the containers of FIG. 29 stacked in a low stack position.
Figure 35:
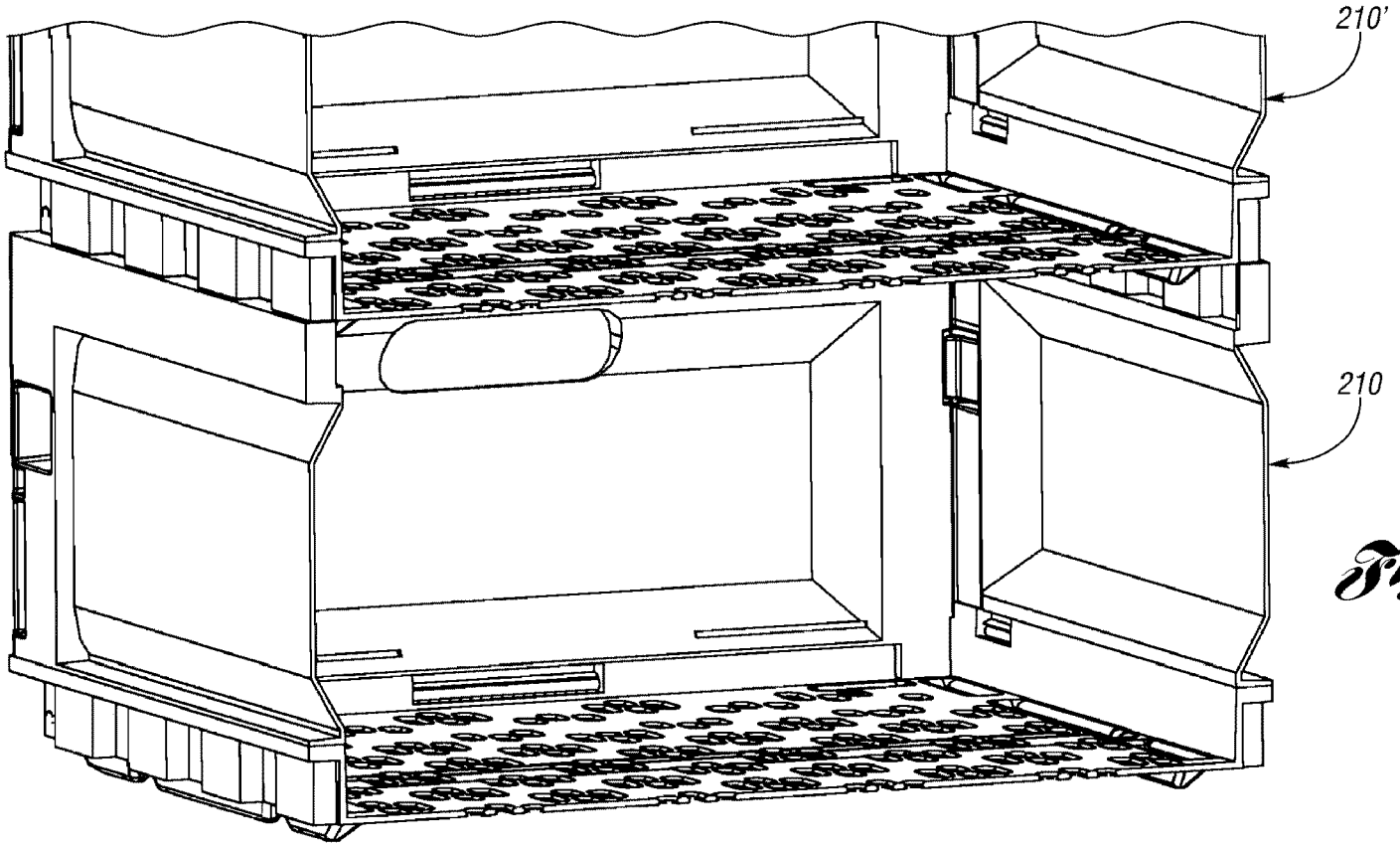
FIG. 35 is a perspective view, partially broken away of the containers of FIG. 33.

FIG. 33 is an exterior view showing the upper container 210' with the projections 220' and recesses 222' aligned with the recesses 224 and projections 226 of the lower container 214. In this orientation, the containers 210, 210' can be stacked as shown in FIG. 34, at a lower stacking height. FIG. 35 is a perspective view, partially broken away of the containers of FIG. 33.

Figure 36:
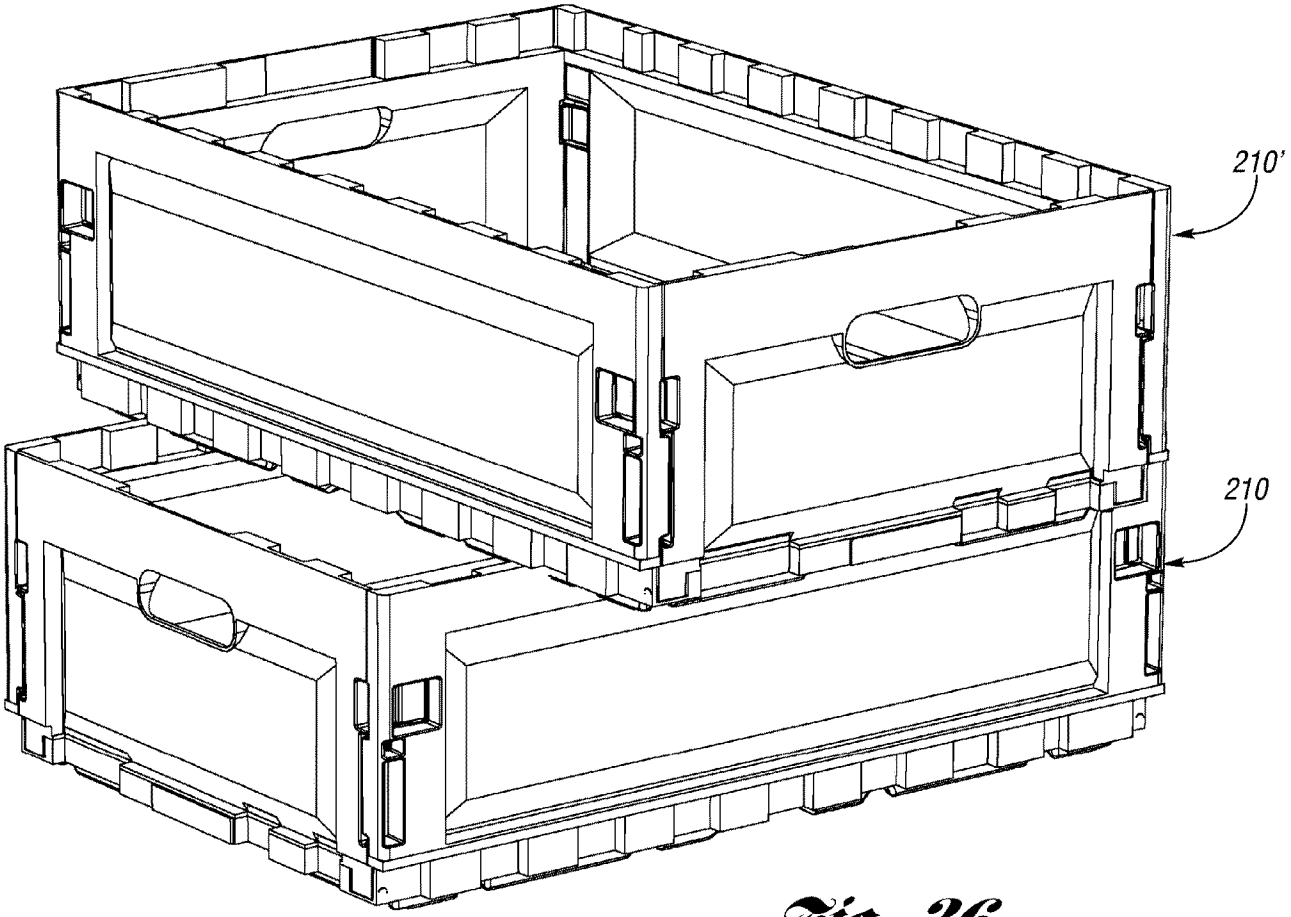
FIG. 36 illustrates the containers of FIG. 33 in the process of the upper container being rotated 180 degrees relative to the lower container.
Figure 37:
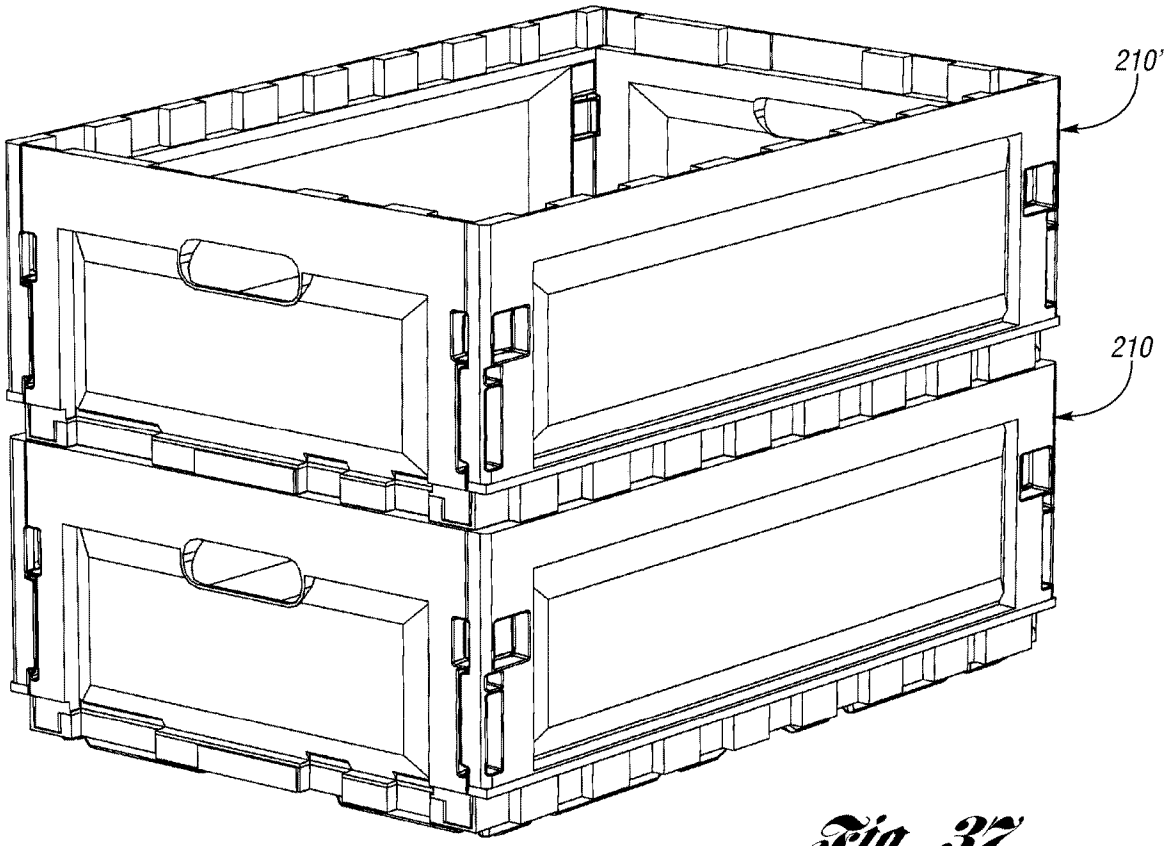
FIG. 37 shows the upper container rotated 180 degrees relative to the lower container and stacked at the high stacked height.
Figure 38:
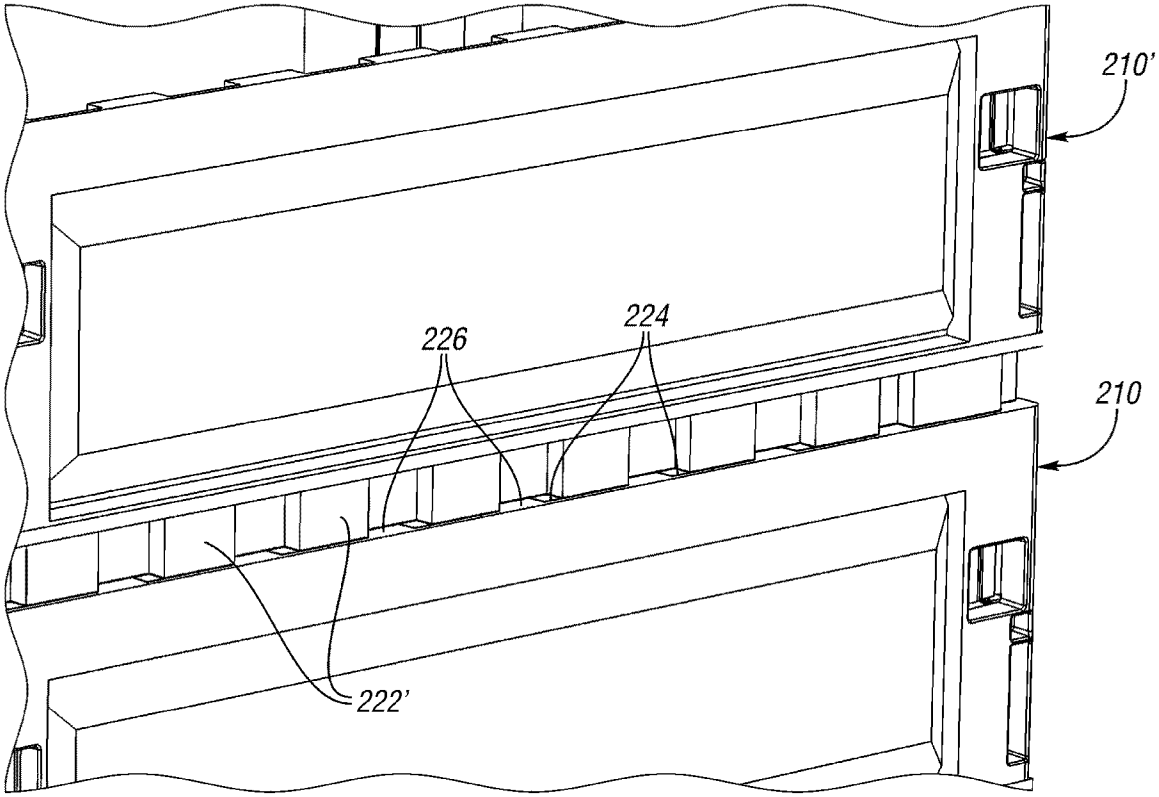
FIG. 38 is an enlarged view of the side walls of the containers of FIG. 37.
Figure 39:
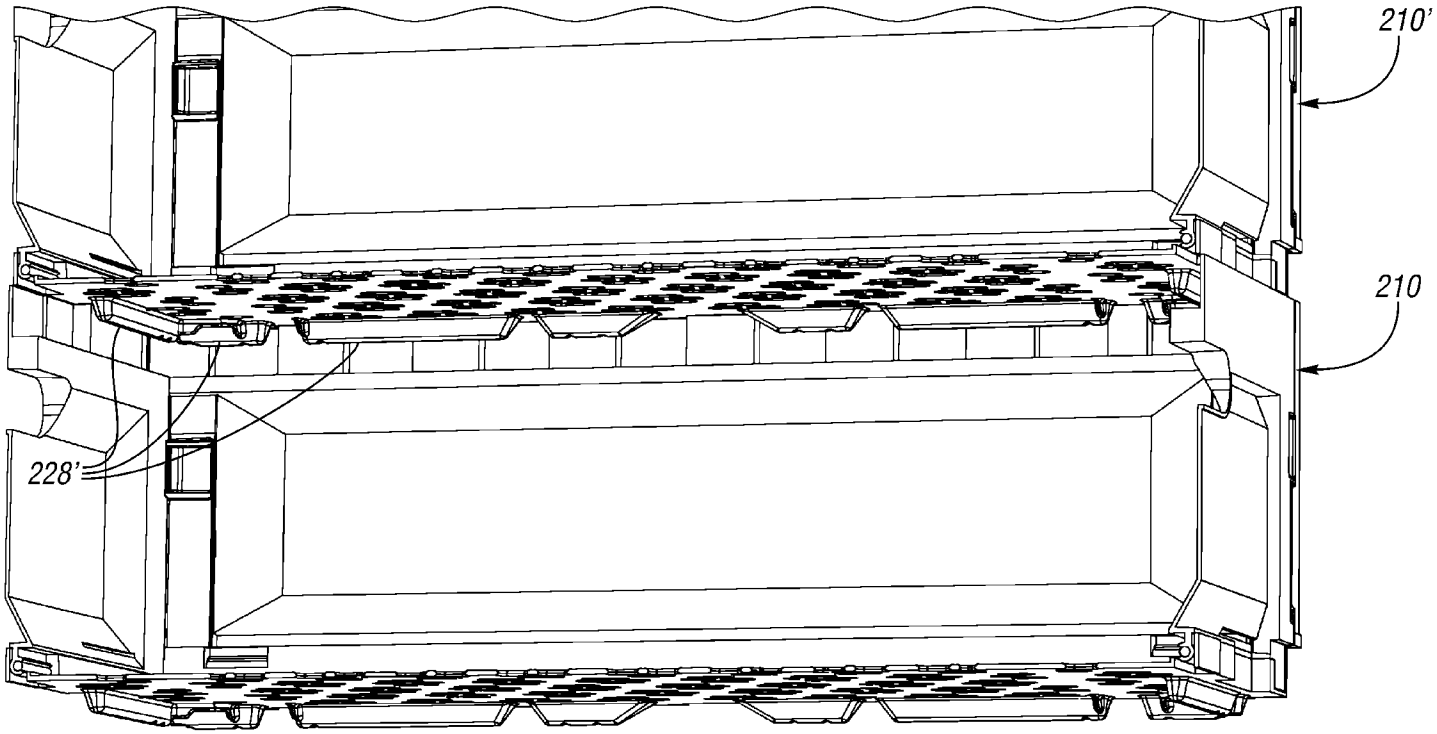
FIG. 39 is a section view through the containers of FIG. 38.
Figure 40:
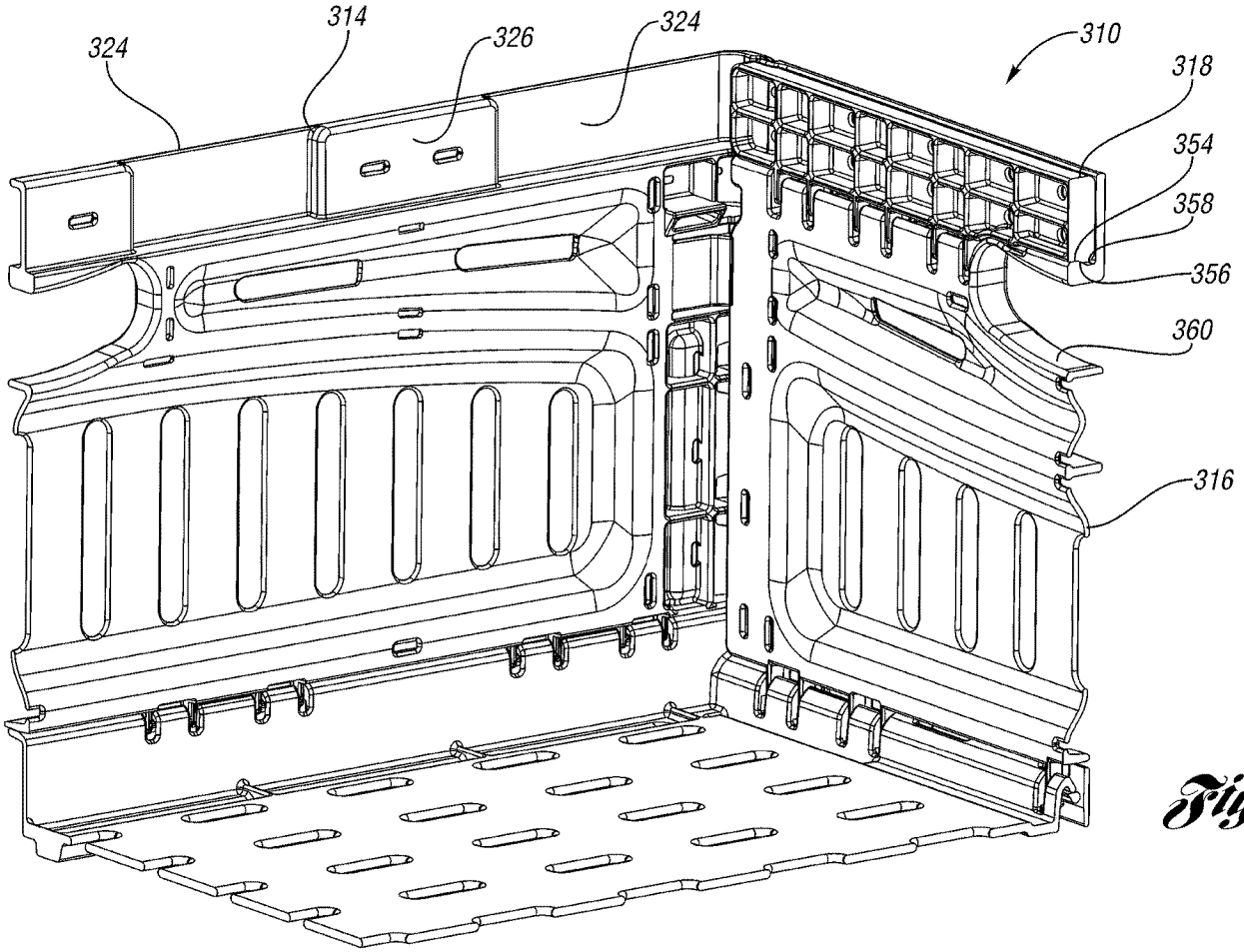
FIG. 40 is an interior view of one corner of a container according to a fourth embodiment.

FIG. 36 illustrates the containers of FIG. 33 in the process of the upper container 210' being rotated toward a position, as shown in FIG. 37 where the upper container 210' is oriented 180° relative to the bottom container 210. As shown in FIG. 38, in this position, the projections 222 of the upper container 210' at least partially align with the projections 226 of the lower container 210, such that the upper container 210' is stacked at a higher height, to maximize the interior storage space in the lower container 210. FIG. 39 is a section view through the containers 210, 210' of FIG. 38. As shown, in the upper stacking height, the drag feet 228' of the upper container 210' are still within the walls of the lower container 210, to provide a stable stack. Thus, the container 210 provides two stacking heights without the use of pivotable supports, in a collapsible container. The two heights permit the interior storage space to either be maximized (upper stacking height) or reduced for efficiency when the maximum storage space is not required.

FIGS. 40 to 44 show a container 310 according to a fourth embodiment. The container 310 is generally the same as the container 10 of FIG. 1, except as shown or described. The container 310 includes a support 318 mounted to each end wall 316. To retain the support 318 in the retracted position, the end wall 316 and support 318 include a detent. The end wall 316 includes an upward projection 354 that snaps into a recess 356 on the underside of the support 318 (in the retracted position). A downward projection 358 from the support 318 snaps behind the upward projection 354 on the end wall 31.

Figure 41:
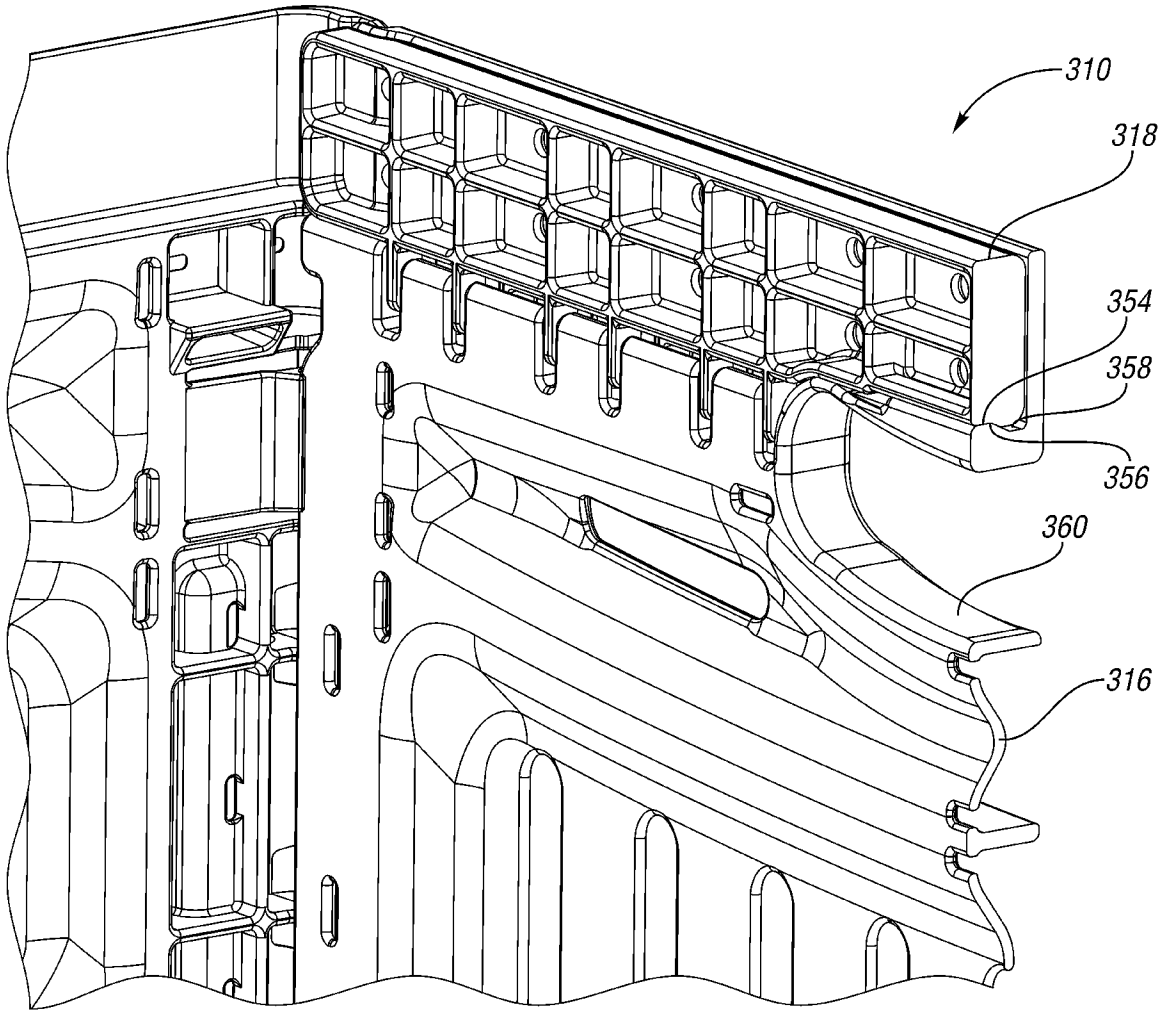
FIG. 41 is an enlarged view of the corner of FIG. 40.

Referring to FIG. 41, in the example shown, the detent is formed above a handle opening 360 through the end wall. Other locations could be used instead or in addition, but the location above the handle opening 360 is convenient because there is no hinge there and because it is centrally located.

Figure 42:
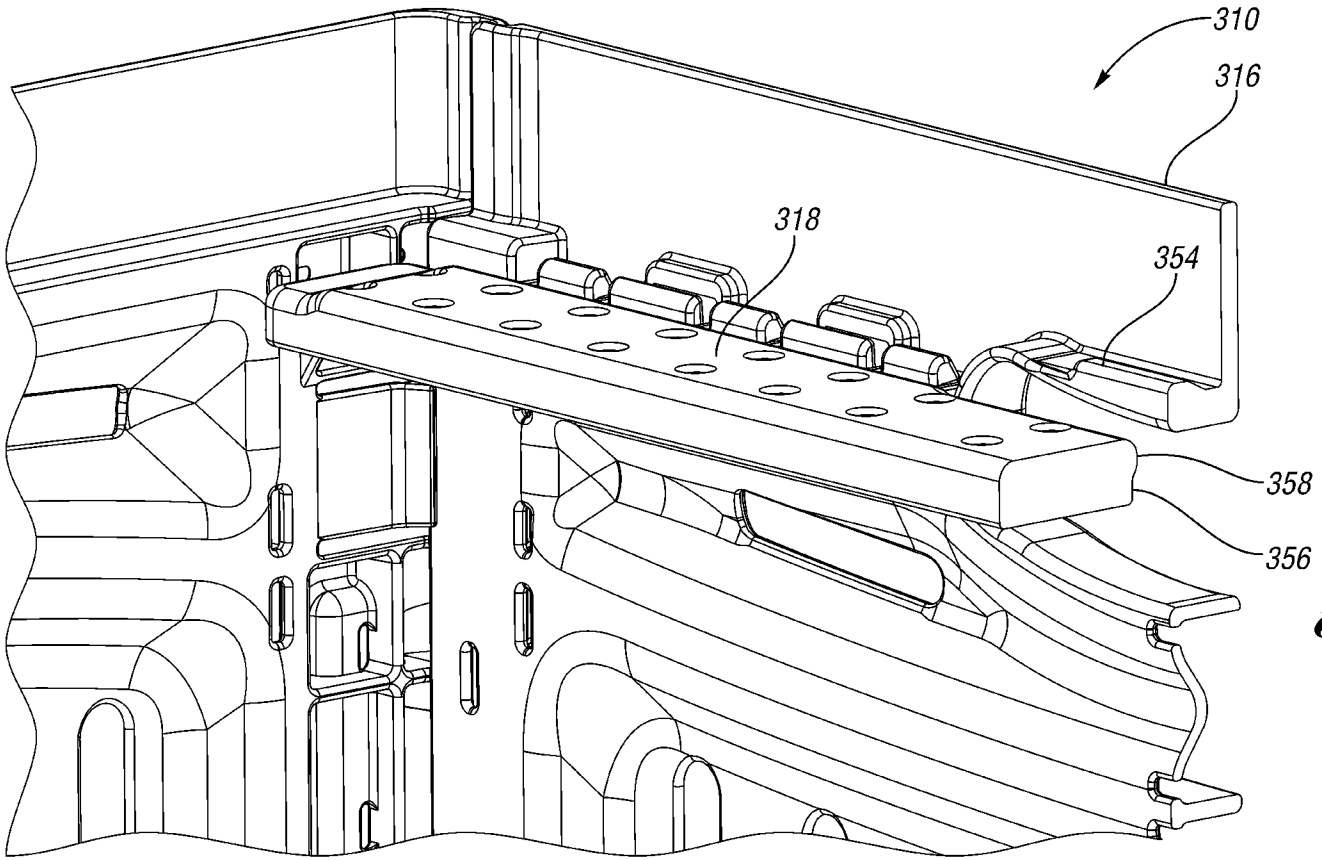
FIG. 42 shows the support of FIG. 41 in the extended position.
Figure 43:
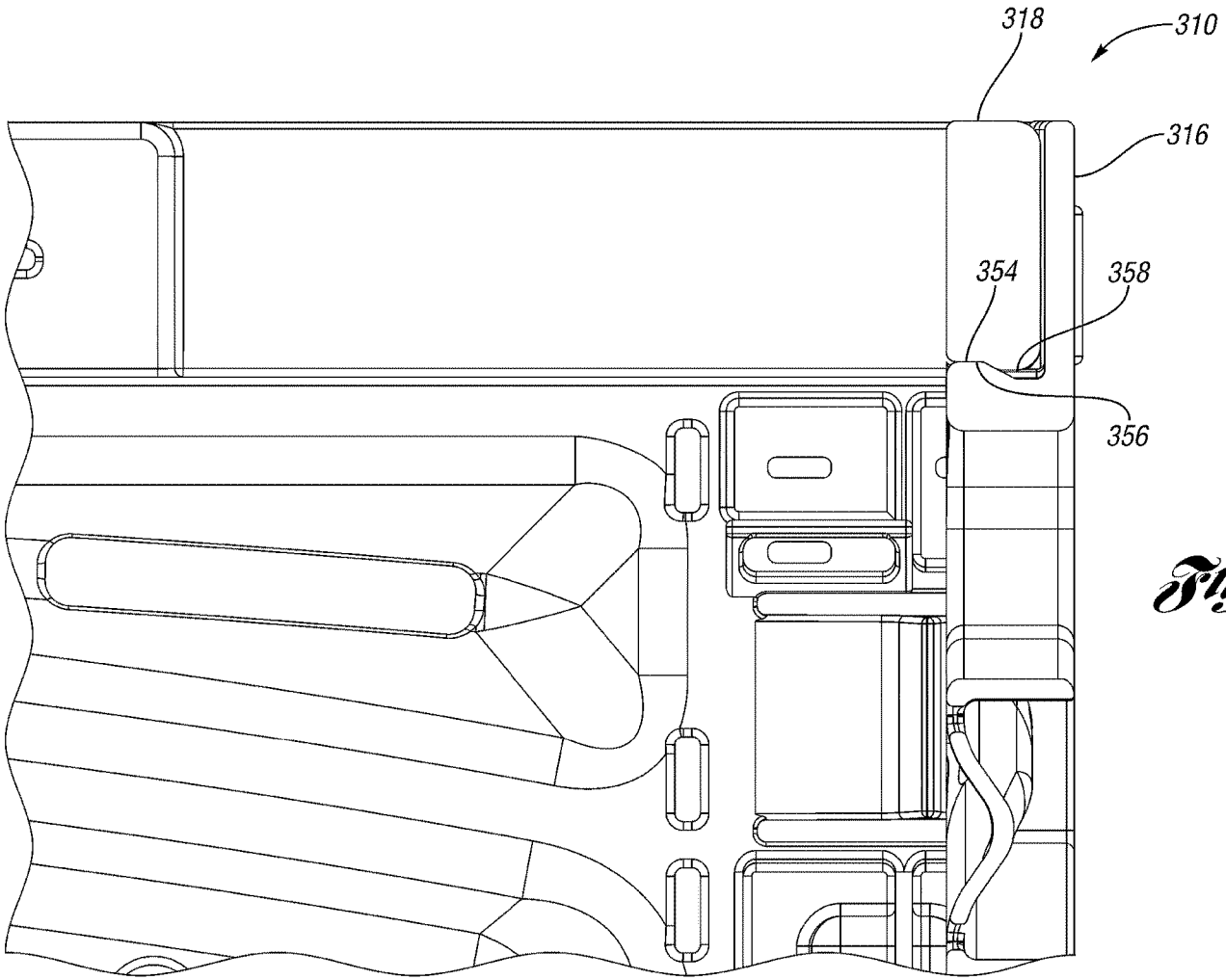
FIG. 43 is a section view through the end wall of FIG. 40 with the support in the retracted position.
Figure 44:
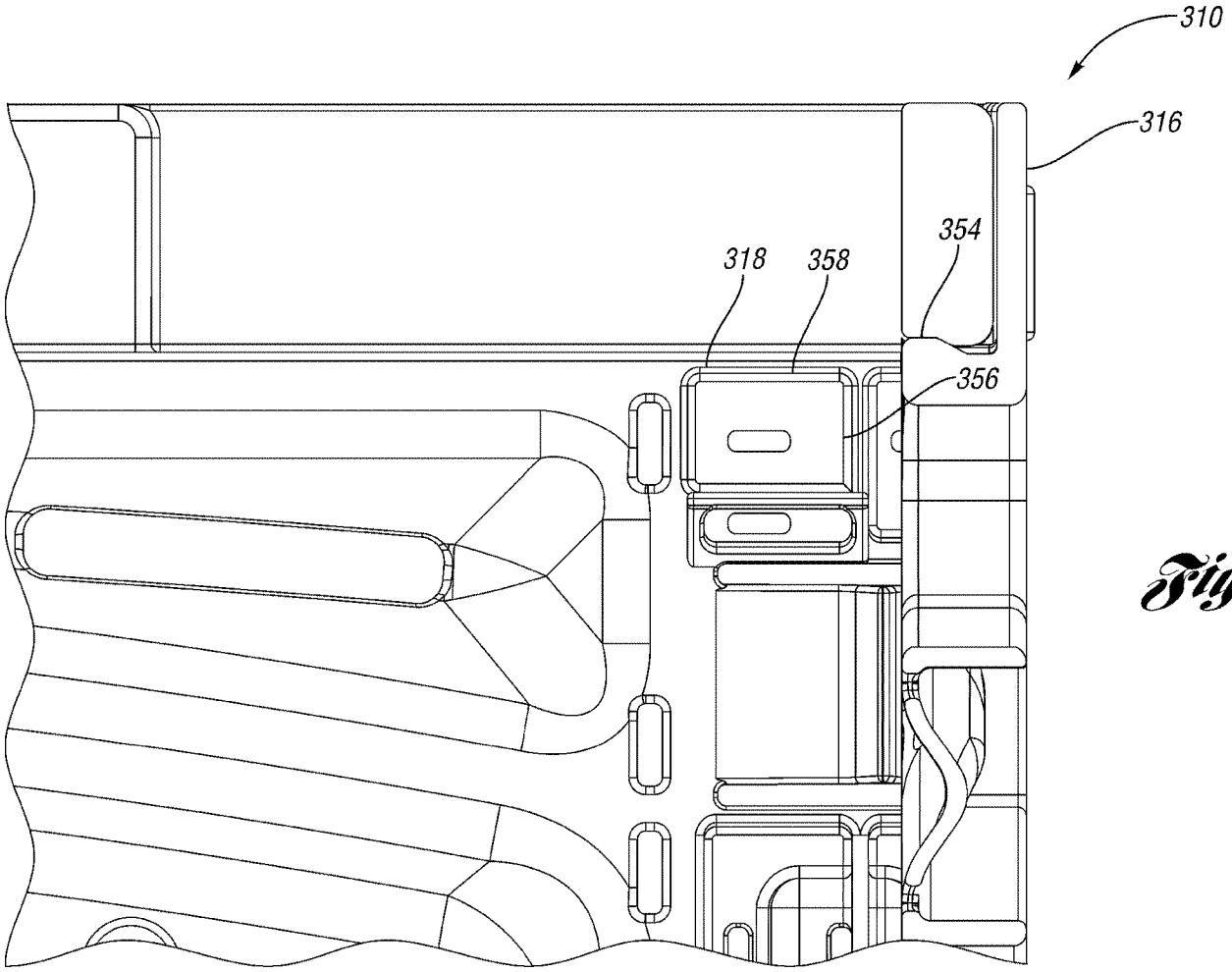
FIG. 44 shows the support of FIG. 43 in the extended position.

As shown in FIGS. 42 and 44, the support 318 can be forced down past the upward projection 354 by a user, and the container is used as described above with respect to the embodiment of FIG. 1.

Figure 45:
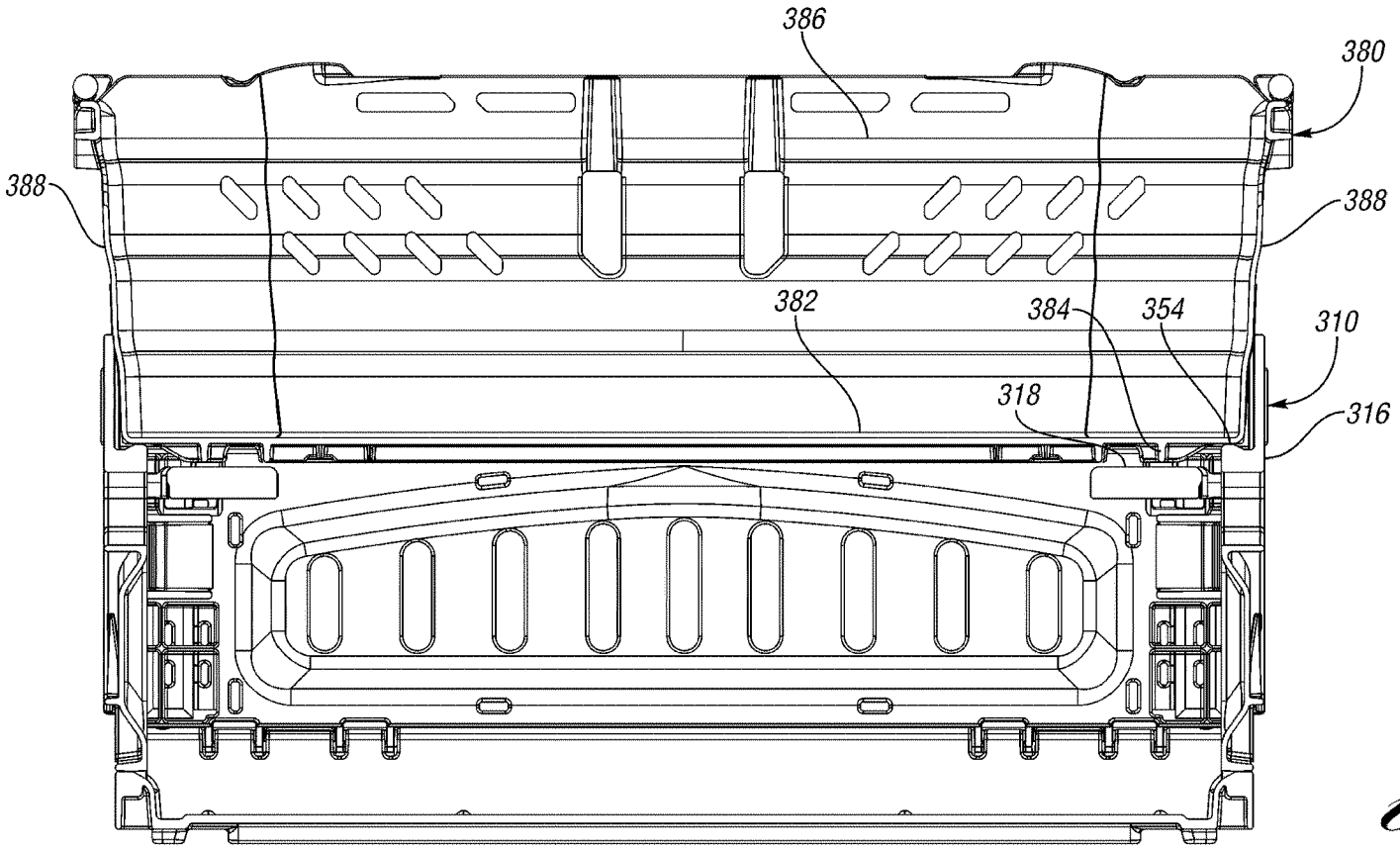
FIG. 45 is a section view of a nestable container supported on the supports of the container of FIG. 44.

As shown in FIG. 45, the supports 318 can also support another type of container, specifically a nestable container 380, thereon. The example nestable container 380 includes a base wall 382 having ribs 384 that projecting downwardly. Side walls 386 and end walls 388 extend upwardly from the periphery of the base wall 382 to define the nestable container 380 interior. The base wall 382 and/or the ribs 384 may contact the supports 318. The base wall 382 may contact the upward projection 354 on the end wall 316, as shown. In this manner, the nestable container 318 can be more stably stacked on the supports 318 of the container 310.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A collapsible container comprising:

a base;

a plurality of walls, including a first wall, the plurality of walls movable between an upright position generally transverse to the base and a collapsed position on the base; and a support movable between a first position and a second position relative to the first wall, wherein the support is pivotably connected to the first wall, wherein the first position is a retracted position and wherein the second position is an extended position, wherein the support is movable toward an interior of the container away from the first wall from the retracted position toward the extended position, wherein an identical container would stack on the collapsible container at a first height when the support is in the first position and the plurality of walls are in the upright position and at a second height when the support is in the second position and the plurality of walls are in the upright position.

2. The collapsible container of claim 1 wherein the first height is greater than the second height.

3. The collapsible container of claim 1 wherein the first height is less than the second height.

4. The collapsible container of claim 1 wherein the first wall includes a detent or stop for preventing the support from moving from the first position to the second position.

5. The collapsible container according to claim 1 wherein a periphery of the base of the collapsible container includes a plurality of alternating recesses and projections complementary to a plurality of alternating recesses and projections at an upper edge of the plurality of walls.

6. The collapsible container of claim 1 wherein the base includes a planar portion having at least one foot projecting downward therefrom, wherein when the identical container is stacked at the first height on the collapsible container, the at least one foot of the identical container extends below the uppermost edge of the plurality of walls of the collapsible container and the planar portion is above the uppermost edge of the plurality of walls of the collapsible container.

7. The collapsible container of claim 1 wherein the base includes a planar portion, wherein the planar portion of the identical container is stacked on the support when the support is in the second position.

8. The collapsible container of claim 1 wherein the base of the identical container is stacked on the support when the support is in the second position.

9. The collapsible container of claim 1 wherein the plurality of walls includes four walls.

10. A collapsible container comprising:

a base;

a plurality of walls, including a first wall, the plurality of walls movable between an upright position generally transverse to the base and a collapsed position on the base; and a support movable between a first position and a second position relative to the first wall, wherein an identical container would stack on the collapsible container at a first height when the support is in the first position and the plurality of walls are in the upright position and at a second height when the support is in the second position and the plurality of walls are in the upright position, wherein a periphery of the base of the collapsible container includes a plurality of alternating recesses and projections complementary to a plurality of alternating recesses and projections at an upper edge of the plurality of walls, wherein the plurality of walls include a second wall connected by a hinge to the base, wherein the hinge is contained within one of the plurality of projections of the periphery of the base.

11. The collapsible container of claim 10 wherein the support is pivotably connected to the first wall, wherein the first position is a retracted position and wherein the second position is an extended position, wherein the support is movable toward an interior of the container away from the first wall from the retracted position toward the extended position, wherein the first height is greater than the second height.

12. The collapsible container of claim 11 wherein the projections of the identical container would be supported on the support of the container when the identical container is stacked on the container when the support is in the first position.

13. A collapsible container comprising:

a base;

a plurality of walls, including a first wall, the plurality of walls movable between an upright position generally transverse to the base and a collapsed position on the base; and a support movable between a first position and a second position relative to the first wall, wherein the support is pivotably and slidably connected to the first wall, wherein an identical container would stack on the collapsible container at a first height when the support is in the first position and the plurality of walls are in the upright position and at a second height when the support is in the second position and the plurality of walls are in the upright position.

14. A collapsible container comprising:

a base; and a plurality of walls, pivotably connected to the base and pivotable between an upright position and a collapsed position on the base, a periphery of the base of the collapsible container includes a plurality of alternating recesses and projections complementary to a plurality of alternating recesses and projections at an upper edge of the plurality of walls, wherein the plurality of alternating recesses and projections on the periphery of the base and on the upper edge of the plurality of walls are configured such that an identical container can be stacked in a first orientation and in a second orientation, 180 degrees from the first orientation, on the collapsible container while the plurality of walls of the collapsible container are in the upright position, and such that identical container would be at a first height in the first orientation and at a second height in the second orientation, wherein the first height is different from the second height.

15. The collapsible container according to claim 14 wherein the first orientation is such that the plurality of projections on the base of the identical container are received in the plurality of recesses at the upper edge of the plurality of walls of the collapsible container, and wherein the first height is less than the second height.

16. The collapsible container according to claim 15 wherein the second orientation is such that the plurality of projections on the base of the identical container are stacked on the plurality of projections at the upper edge of the plurality of walls of the collapsible container, and wherein the first height is less than the second height.

17. The collapsible container according to claim 16 wherein the plurality of walls include a side wall connected by a hinge to the base, wherein the hinge is contained within one of the plurality of projections of the periphery of the base.

18. The collapsible container of claim 14 wherein the plurality of walls includes four walls.

19. A collapsible container comprising:

a base, a periphery of the base of the collapsible container includes a plurality of alternating recesses and projections, the projections projecting laterally in a direction parallel to the plane of the base relative to the recesses; and a plurality of walls pivotably connected to the base and collapsible onto the base, wherein the plurality of walls include at least one wall connected by a hinge to the base, wherein the hinge is located in one of the plurality of projections of the periphery of the base.

20. The collapsible container according to claim 19 wherein the alternating recesses and projections are complementary to a plurality of alternating recesses and projections at an upper edge of the plurality of walls.

21. The collapsible container of claim 20 wherein the plurality of alternating recesses and projections at the upper edge of the plurality of walls are formed in an inner peripheral edge of the upper edge of the plurality of walls.

22. The collapsible container of claim 19 wherein the base includes a planar portion for supporting goods thereon, wherein the planar portion of the base is coplanar with the plurality of alternating recesses and projections of the base.

23. The collapsible container of claim 22 wherein the plurality of recesses of the base are open downwardly of the container.

24. The collapsible container of claim 23 wherein the alternating recesses and projections of the base are complementary to a plurality of alternating recesses and projections in an inner peripheral edge of an upper edge of the plurality of walls, such that the alternating recesses and projections of the base could be received in the alternating recesses and projections in the inner peripheral edge of the upper edge of the plurality of walls of an identical container stacked therebelow, with the planar portion of the base of the container received between the plurality of walls of the identical container.

* * * * *